US007771006B2

(12) United States Patent
Morikoshi

(10) Patent No.: US 7,771,006 B2
(45) **Date of Patent: *Aug. 10, 2010**

(54) LIQUID EJECTING APPARATUS AND CAPPING MEMBER USED IN THE SAME

(75) Inventor: Koji Morikoshi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 383 days.

This patent is subject to a terminal disclaimer.

(21) Appl. No.: 11/857,945

(22) Filed: Sep. 19, 2007

(65) Prior Publication Data

US 2008/0049065 A1 Feb. 28, 2008

Related U.S. Application Data

(62) Division of application No. 10/651,284, filed on Aug. 29, 2003, now Pat. No. 7,338,146.

(30) Foreign Application Priority Data

Aug. 29, 2002 (JP) ..... 2002-250811
Oct. 25, 2002 (JP) ..... 2002-310394

(51) Int. Cl.
*B41J 2/165* (2006.01)

(52) U.S. Cl. ..... 347/33

(58) Field of Classification Search ..... 347/29–30, 347/32–33

See application file for complete search history.

(56) References Cited

U.S. PATENT DOCUMENTS 5,504,508 A 4/1996 Hashimoto (Continued)

FOREIGN PATENT DOCUMENTS

JP 6-191061 7/1994

(Continued)

*Primary Examiner*—Lamson D Nguyen
(74) *Attorney, Agent, or Firm*—Sughrue Mion, PLLC

(57) ABSTRACT

A liquid ejecting apparatus includes a liquid ejecting head, a capping member sealing a nozzle forming face of the liquid ejecting head, and a suction unit applying a negative pressure to the nozzle forming face of the liquid ejecting head in a state that the nozzle forming face is sealed with the capping member so that the liquid in the liquid ejecting head is exhaust through a suction port of the capping member. The liquid ejecting head includes the nozzle forming face having a plurality of nozzle opening arrays, a plurality of pressure generating chambers communicating with the nozzle openings respectively, and a plurality of pressure generating members applying pressure to liquid in the pressure generating chambers respectively so as to eject the liquid from the nozzle openings. Each of the nozzle opening arrays has plural nozzle openings. The nozzle opening arrays includes at least one main nozzle opening array for ejecting a first liquid and at least one sub-nozzle opening array for ejecting a second liquid which is different from the first liquid in function. A defining member is provided in the capping member which divides the inner space formed in the state that the nozzle forming face is sealed with the capping member into a first liquid receiving portion corresponding to the main nozzle opening array, and a second liquid receiving portion corresponding to the sub-nozzle opening array, and defines the first liquid receiving portion and the second liquid receiving portion so as to communicate with each other.

5 Claims, 19 Drawing Sheets

U.S. PATENT DOCUMENTS

| | | | | |
|---|---|---|---|---|
| 5,798,775 | A | 8/1998 | Takahashi et al. | |
| 5,835,109 | A | 11/1998 | Uchida | |
| 6,155,666 | A | 12/2000 | Sugimoto et al. | |
| 6,293,647 | B2 | 9/2001 | Saijo | |
| 6,296,342 | B1 | 10/2001 | Oikawa | |
| 6,554,396 | B1 | 4/2003 | Mizutani | |
| 7,338,146 | B2 * | 3/2008 | Morikoshi | 347/29 |
| 2002/0012023 | A1 | 1/2002 | Shigeno | |

FOREIGN PATENT DOCUMENTS

| | | | |
|---|---|---|---|
| JP | 06-328703 | A | 11/1994 |
| JP | 7-290716 | A | 11/1995 |
| JP | 8-281968 | | 10/1996 |
| JP | 09-290512 | A | 11/1997 |
| JP | 10-76678 | A | 3/1998 |
| JP | 10-128988 | A | 5/1998 |
| JP | 2001-180006 | | 7/2001 |

* cited by examiner

LIQUID EJECTING APPARATUS AND CAPPING MEMBER USED IN THE SAME

CROSS-REFERENCE TO RELATED APPLICATIONS

This is a divisional of prior application Ser. No. 10/651,284 filed Aug. 29 2003. Application Ser. No. 10/651,284 claims foreign priority from Japanese patent application 2002-250811 filed Aug. 29, 2002 and from Japanese patent application 2002-310394 filed Oct. 25, 2002. The entire disclosures of the prior U.S. application and the two Japanese patent applications are hereby incorporated by reference.

BACKGROUND OF THE INVENTION

The present invention relates to a liquid ejecting apparatus, and particularly to a liquid ejecting apparatus provided with a liquid ejecting head which can be utilized as a recording head that ejects ink to a recording medium to perform recording, a color material ejecting head used in manufacture of a color filter of a liquid crystal display, an electrode material (electric conducting paste) ejecting head used in formation of electrodes of an organic EL display and FED (face light emitting display), a bioorganic matter ejecting head used in manufacture of biochip, or a sample ejecting head used as a precise pipette.

As a representative example of the liquid ejecting apparatus, an ink jet recording apparatus is known. This ink jet recording apparatus includes a recording head mounted on a carriage which reciprocates in a main scanning direction, and a recording medium feeding unit which feeds a recording medium such as a printing sheet intermittently in a sub-scanning direction by the predetermined amount, and ejects an ink droplet from the recording head during moving the recording head in the main scanning direction thereby to perform recording. In the ink jet recording apparatus, as known well, ink is pressurized in a pressure generating chamber at a predetermined pressure, and the ink is ejected from a nozzle opening in a nozzle forming face on the basis of its pressure to the recording medium as an ink droplet having a controlled size. Accordingly, ink ejection characteristic of the recording head from the nozzle opening must be kept constant, and variation of the ink ejection characteristic causes deterioration of recording quality.

The ink ejection characteristic of the recording head varies because of nozzle clogging caused by adhesion of hardened ink and dust onto the nozzle forming face, and intrusion of air bubbles from the nozzle. Therefore, in order to keep the ink ejection characteristic of the recording head constant, the ink jet recording apparatus is provided with an ejection characteristic keeping device which removes each reason of the variation of the ink ejection characteristic, and keeps the ejection characteristic of the recording head.

The ejection characteristic keeping device usually includes a capping unit firstly. In no-recording, the nozzle forming face is sealed by this capping unit to isolate the nozzle opening from the outside, whereby dry of ink is suppressed, and increase of ink viscosity is suppressed.

Further, even in case that the nozzle forming face is sealed by the capping unit, clogging of the nozzle opening and mixing of air bubbles into an ink flowing passage can be not prevented completely. Therefore, in order to remove the clogging of the nozzle opening and the mixed air bubbles, the ejection characteristic keeping device includes secondarily a suction unit which can suck and exhaust the ink from the nozzle opening forcedly. This suction unit, in a state where the nozzle forming face is sealed by the capping unit, applies a negative pressure to the nozzle opening, and sucks and exhausts the ink from the nozzle opening forcedly thereby to remove the clogging and the mixed air bubbles. The forced sucking and exhausting processing of ink by this suction unit is called as cleaning. Usually, in case that a recording operation is restarted after the recording apparatus has been stopped for a long time, or in case that a user recognizes the deterioration of quality of a recording image and operates a special switch on an operational panel, cleaning is executed.

When the forced sucking and exhausting processing of ink is thus performed by the suction unit, the ink frequently scatters on the nozzle forming face of the recording head is adhered thereon, and meniscus of ink in each nozzle opening is disordered. Further, foreign matters are easy to be attached on the nozzle forming face of the recording head with the passage of time. Therefore, the ejection characteristic keeping device includes thirdly a wiping member which wipes the nozzle forming face according to necessity. This wiping member has a wiping member made of elastic material such as rubber, and the base end side of the wiping member is held and supported by a holder. The edge portion on the leading end side of the wiping member or its surrounding portion is elastically pressed against the nozzle forming face and moved relatively thereby to clean the nozzle forming face. The cleaning operation by the wiping member is called as a wiping operation. By this wiping operation, the ink and dust attached onto the nozzle forming face are wiped, and further this operation performs a part of making the meniscus of ink in each nozzle opening uniform, that is, a part of stabilizing the meniscus of ink.

In the thus constructed ink jet recording apparatus, in order to improve fixability of ink onto the recording medium, recently a recording method in which a fixing liquid that acts on ink to heighten color forming ability is ejected in addition to the ink is being developed. Namely, in this double liquid fixing system, the fixing liquid (second liquid) which has cationic resin as a main component and does not include ink is ejected onto the recording medium in addition to the ink (first liquid), whereby electric stability of dispersion medium (usually, anionic resin is used.) of pigment included in the ink is changed to urge the cohesive power of the pigment, and the fixability of ink onto the recording medium surface is improved. Hereby, improvement of glossiness in ink jet paper and improvement of color forming ability in plain paper are simultaneously realized.

In the double liquid fixing system, in case that the first liquid and the second liquid are mixed, the cohesion of the pigment is produced due to the properties of these liquids, so that clogging of the nozzle is caused. Accordingly, not only in the ink cartridge but also around the recording head (for example, on the nozzle forming face), mixing of these liquids must be avoided. Therefore, in the double liquid fixing system, it is necessary to constitute the flowing passage and the nozzle opening separately between the ink and the fixing liquid.

By the way, the related ink jet recording apparatus includes the ejection characteristic keeping device, and this device performs the wiping operation of the nozzle forming face of the recording head and the suction operation in the state where the nozzle forming face is sealed (capped). In this wiping process, if the first liquid and the second liquid which are attached onto the nozzle forming face are mixed, the cohesion of the pigment is produced on the nozzle forming face, and clogging is produced in the nozzle opening, which causes ejection trouble. In order to avoid such the unintended mixing state of the first liquid and the second liquid, it is effective to set the recording heads separately or set the wiping members separately. However, this complicates the constitution of the apparatus and increases the number of parts, so that this is not a realistic solving means in the ink jet recording apparatus in which many functional parts have been already collected in the limited space.

Further, also in the sucking operation, in case that the both liquids are mixed in the cap, cohered matters remain in the cap or clogging of the suction port that is an outlet of the waste ink is caused. Particularly, in case that the both liquids are filled in the cap in the state where they are mixed, there is possibility that the cohered matters are attached onto the nozzle forming face and clogging of the nozzle opening is caused similarly to in case of wiping. Also in this case, it is effective to set the recording heads and the capping units separately between the first liquid and the second liquid (for example, refer to JP-A-8-281968). However, this causes complicacy of the apparatus constitution and increase of the number of parts.

Further, in an ink jet recording apparatus so constructed that ink of plural colors are ejected from a single recording head, a technology of defining the inside of the cap to prevent color mixing is proposed (for example, refer to JP-A-6-191061). However, this ink jet recording apparatus does not relate to the double liquid fixing system, and a suction port is provided for each defined portion. Therefore, since waste ink passages connecting the cap and the sucking unit must be provided separately, the constitution becomes complicated, which is contrary to the above requirement.

The problem of mixture in the double liquid fixing type ink jet recording apparatus is produced also in another liquid ejecting apparatus utilizing the liquid ejecting head such as the precious pipette which ejects a test liquid (sample) and the specified reagent having reactivity to the test liquid.

SUMMARY OF THE INVENTION

It is therefore an object of the present invention to provide a liquid ejecting apparatus which ejects a first liquid and a second liquid from their separate nozzle opening arrays and can avoid as much as possible the unintended mixture of the first liquid and the second liquid around a liquid ejecting head in an ejection characteristic keeping operation.

In order to achieve the above object, according to the present invention, there is provided a liquid ejecting apparatus. It includes a liquid ejecting head, with: a nozzle forming face having a plurality of nozzle opening arrays; wherein each of the nozzle opening arrays has plural nozzle openings; and wherein the nozzle opening arrays includes at least one main nozzle opening array for ejecting a first liquid and at least one sub-nozzle opening array for ejecting a second liquid which is different from the first liquid in function; a plurality of pressure generating chambers, communicating with the nozzle openings respectively; and a plurality of pressure generating members, applying pressure to liquid in the pressure generating chambers respectively so as to eject the liquid from the nozzle openings. It also includes a capping member, sealing the nozzle forming face of the liquid ejecting head; and a suction unit, applying a negative pressure to the nozzle forming face of the liquid ejecting head in a state that the nozzle forming face is sealed with the capping member so that the liquid in the liquid ejecting head is exhaust through a suction port of the capping member, wherein a defining member is provided in the capping member, which divides the inner space formed in the state that the nozzle forming face is sealed with the capping member into a first liquid receiving portion corresponding to the main nozzle opening array, and a second liquid receiving portion corresponding to the sub-nozzle opening array, and defines the first liquid receiving portion and the second liquid receiving portion so as to communicate with each other.

According to this liquid ejecting apparatus, since the defining member is provided, which divides the inside of the capping member into the first liquid receiving portion and the second liquid receiving portion, and defines these first liquid receiving portion and second liquid receiving portion so that they can communicate with each other, contact between the first liquid and the second liquid in the capping member during the sucking operation can be suppressed to a minimum. Therefore, it can be prevented that the reaction between the first liquid and the second liquid is produced in the capping member thereby to cause clogging due to cohesion and hardening of liquid.

Further, because of the simple constitution that the defining member is provided in the capping member, it is not necessary to complicate the constitution of the capping member or enlarge the arrangement space, so that the constitution other than the capping member is the same as that in the capping member in the related liquid ejecting apparatus. Further, by providing the defining member, not only in the sucking operation but also in a flashing operation, mixing of the first liquid and second liquid ejected to the capping member can be also prevented.

Preferably, the defining member is a wall body formed between the first liquid receiving portion and the second liquid receiving portion. The top of the wall body is formed with a distance from the nozzle forming face in the state that the nozzle forming face is sealed with the capping member. According to this feature, since the defining member is the wall body, the first liquid receiving portion and the second liquid receiving portion can be defined with the simple constitution. Further, since the top of the wall body is formed with a distance from the nozzle forming face in the state where the capping member seals the nozzle forming face, the first liquid receiving portion and the second receiving portion can be separated, while the communicating state of them can be also kept.

Preferably, the suction port is provided so as to face the second liquid receiving portion. According to this feature, since the suction port from which the waste liquid in the capping member is exhausted at the sucking operation time is provided so as to face the second liquid receiving portion, the second liquid is preferentially exhausted from the capping member at the sucking time, and then the first liquid flows from the first liquid receiving portion into the second liquid receiving portion thereby to be exhausted from the suction port. Hereby, the exhausts of the first liquid and the second liquid are performed with difference of time, so that mixing of the first liquid and the second liquid in the capping member is nearly prevented. Accordingly, though the suction port is formed in only the one position, formation of the cohered matters and the hardened matters with which the suction port is clogged can be avoided.

Preferably, a dry preventing member for preventing dry of the nozzle forming face is provided in the capping member. According to this feature, since the dry preventing member is provided in the capping member, the humidity in the capping member can be kept suitable in the state where the capping member comes into contact with the nozzle forming face of the liquid ejecting head and seals the nozzle forming face. Hereby, the dry of the liquid in the nozzle and the increase of viscosity can be prevented.

Here, as the dry preventing member, a member having the known constitution can be adopted, and for example, a sheet member made of porous material such as foaming urethane can be used as shown in a later-described embodiment. Further, according to necessity, it is possible to include moisture keeping component in the sheet member, and further the laminated sheets different in mesh diameter can be used as the sheet material.

Preferably, the dry preventing member is provided in only the first liquid receiving portion. According to this feature, since the dry preventing member is provided for only the first liquid receiving portion, it does not cause clogging.

Namely, the dry preventing member provided for only the first liquid receiving portion, comes into contact with only the waste liquid of the first liquid, so that the contact with the second liquid is prevented. Therefore, in the dry preventing member, the first liquid and the second liquid do not react on each other to cause the cohesion. Further, since the defining member defines the first liquid receiving portion and the second liquid receiving portion so that they can communicate with each other, action of preventing dry of the nozzle forming face (moisture keeping action) is kept at the cap-sealing time.

Preferably, the liquid ejecting apparatus further comprises a wiping member wiping the nozzle forming face. An extending direction of each of the nozzle opening arrays is perpendicular to a wiping direction in which the wiping member wipes. The sub-nozzle opening array is arranged on the more downstream side in the wiping direction than the main nozzle opening array.

According to this feature, it is possible not only to prevent the first liquid and the second liquid from mixing with each other in the capping member at the sucking operation time, but also to prevent the first liquid and the second liquid from mixing with each other around the liquid ejecting head at the wiping operation time. Accordingly, in the process of the wiping operation and sucking operation for keeping the ejection characteristic of the liquid ejecting head, and further in the sealing state by the capping member (in the process of the capping operation), it is possible to avoid as much as possible the unintended mixing state of the first liquid and the second liquid.

Preferably, the liquid ejecting apparatus is an ink jet recording apparatus.

For the ink jet recording apparatus, in order to keep a good recording performance, the sucking operation and the capping operation are very important, and these operations are performed with high frequency. Since mixing of the first liquid and the second liquid can be prevented at this time, the performance of the recording head can be kept good.

Preferably, the first liquid is ink, and the second liquid is a fixing liquid for ink. Especially, in the ink jet recording apparatus, in case that the first liquid is the ink and the second liquid is the fixing liquid for ink, there is advantage that improvement of glossiness in ink jet paper and improvement of color forming ability in plain paper can be simultaneously realized by the action of the fixing liquid. However, in case that the ink and the fixing liquid mix with each other, pigment in the ink coheres, so that clogging of the nozzle opening is easy to be caused. Accordingly, it is desired that mixture of them around the recording head is avoided as much as possible. In the ink jet recording apparatus, it is possible to suppress or avoid mixing of the ink as the first liquid and the fixing liquid as the second liquid during the ejection characteristic keeping operation. Therefore, while the ejection characteristic is kept and improved, clear recording that is superior in glossiness and color forming ability is realized.

According to the present invention, there is also provided a liquid ejecting apparatus, which has a liquid ejecting head, including a nozzle forming face having a plurality of nozzle opening arrays; wherein the nozzle opening arrays have plural nozzle openings respectively; and wherein the nozzle opening arrays includes at least one main nozzle opening array for ejecting a first liquid and at least one sub-nozzle opening array for ejecting a second liquid which is different from the first liquid in function; a plurality of pressure generating chambers, communicating with the nozzle openings respectively; and a plurality of pressure generating members, applying pressure to liquid in the pressure generating chambers respectively so as to eject the liquid from the nozzle openings. There is also a capping member, sealing the nozzle forming face of the liquid ejecting head; and a suction unit, applying a negative pressure to the nozzle forming face of the liquid ejecting head in a state that the nozzle forming face is sealed with the capping member so that the liquid in the liquid ejecting head is exhaust through a suction port of the capping member, wherein a wall body is provided in the capping member; and wherein the wall body is protruded from a bottom of the capping member toward a portion between the main nozzle opening array and the sub-nozzle opening array on the nozzle forming face so as not to contact with the nozzle forming face in the state that the nozzle forming face is sealed with the capping member.

According to this feature, since the wall body is provided, the contact between the first liquid and the second liquid in the capping member during the sucking operation can be suppressed to a minimum. Accordingly, it can be prevented that the reaction between the first liquid and the second liquid is produced in the capping member thereby to cause clogging due to cohesion and hardening of liquid.

Further, because of the simple constitution that the wall body is provided in the capping member, it is not necessary to complicate the constitution of the capping unit or enlarge the arrangement space, so that the constitution other than the capping member is the same as that in the capping unit in the related liquid ejecting apparatus.

According to the present invention, there is also provided a capping member for sealing a nozzle forming face of a liquid ejecting head which includes a pressure generating chamber communicating with a nozzle opening, and a pressure generating member for applying pressure to liquid in the pressure generating chamber so that the liquid is ejected from the nozzle opening, the capping member including a first liquid receiving portion, corresponding to at least one main nozzle opening array formed on the nozzle forming face for ejecting a first liquid; a second liquid receiving portion, corresponding to at least one sub-nozzle opening array formed on the nozzle forming face for ejecting a second liquid different from the first liquid in function; and a defining member, defining the first liquid receiving portion and the second liquid receiving portion so as to communicate with each other. According to the invention of the capping member, the working effects similar to those in the above liquid ejecting apparatus can be obtained.

According to the present invention, there is also provided a liquid ejecting apparatus, which includes a liquid ejecting head, including: a nozzle forming face having a plurality of nozzle opening arrays which are arranged in parallel to each other; wherein each of the nozzle opening arrays has plural nozzle openings; and wherein the nozzle opening arrays includes at least one main nozzle opening array for ejecting a first liquid and at least one sub-nozzle opening array for ejecting a second liquid which is different from the first liquid in function; a plurality of pressure generating chambers, communicating with the nozzle openings respectively; and a plurality of pressure generating members, applying pressure to liquid in the pressure generating chambers respectively so as to eject the liquid from the nozzle openings. There is also a wiping member, wiping the nozzle forming face, wherein an extending direction of each of the nozzle opening arrays is perpendicular to a wiping direction in which the wiping member wipes; and wherein the sub-nozzle opening array is arranged on the more downstream side in the wiping direction than the main nozzle opening array.

According to this feature, in the liquid ejecting apparatus having the main nozzle opening array for ejecting the first liquid and the sub-nozzle opening array for ejecting the second liquid that is different from the first liquid in function, the sub-nozzle opening array is arranged on the more downstream side in the wiping direction at the wiping operation time than the main nozzle opening array. Therefore, it is possible to prevent the first liquid and the second liquid from mixing with each other around the ejecting head in the wiping operation.

In the invention, "the first liquid and the second liquid are different from each other in function." means that they are in relation that they are different in basic function of liquid, for example, in relation between ink used as the first liquid and a fixing liquid used as the second liquid, or in relation between biosample used as the first liquid and color forming reagent used the second liquid. Accordingly, the above relation does not include a relation between black ink and yellow ink, that is, a relation that they are common in the basic function (function as ink in this example) though they are different simply in property (color).

According to the present invention, there is also provided a liquid ejecting apparatus, which includes a liquid ejecting head, which has: a nozzle forming face having a plurality of nozzle opening arrays which are arranged in parallel to each other; wherein each of the nozzle opening arrays has plural nozzle openings; and wherein the nozzle opening arrays includes at least one main nozzle opening array for ejecting a first liquid and at least one sub-nozzle opening array for ejecting a second liquid which is different from the first liquid in function; a plurality of pressure generating chambers, communicating with the nozzle openings respectively; and a plurality of pressure generating members, applying pressure to liquid in the pressure generating chambers respectively so as to eject the liquid from the nozzle openings. There is also a capping member, sealing the nozzle forming face of the liquid ejecting head; and a suction unit, applying a negative pressure to the nozzle forming face of the liquid ejecting head in a state that the nozzle forming face is sealed with the capping member so that the liquid in the liquid ejecting head is exhaust through a suction port of the capping member, wherein the suction port is formed in a position close to the sub-nozzle opening array in the state that the nozzle forming face is sealed with the capping member.

According to this feature, in the liquid ejecting apparatus having the main nozzle opening array for ejecting the first liquid and the sub-nozzle opening array for ejecting the second liquid that is different from the first liquid in function, the suction port that becomes an exhausting port in the cap member is formed in the position close to the sub-nozzle opening array. Therefore, the second liquid to be exhausted from the sub-nozzle opening array close to the suction port can be preferentially exhausted from the suction port. Accordingly, mixing of the first liquid and the second liquid in the cap member at the sucking operation time is reduced. Namely, in the capping member at the sucking operation time, the ratio of the second liquid to the first liquid can be kept small.

Preferably, the liquid ejecting apparatus further comprises a wiping member which wipes the nozzle forming face. An extending direction of each of the nozzle opening arrays is perpendicular to a wiping direction in which the wiping member wipes. The sub-nozzle opening array is arranged on the more downstream side in the wiping direction than the main nozzle opening array.

According to this feature, in addition to the action that mixing of the first liquid and the second liquid in the capping member at the sucking operation time can be prevented, it is also possible to prevent the first liquid and the second liquid from mixing with each other around the liquid ejecting head during the wiping operation. Accordingly, in the process of the wiping operation and sucking operation for keeping the ejection characteristic of the liquid ejecting head, and further in the sealing state by the capping member (in the process of the capping operation), it is possible to avoid as much as possible the unintended mixing state of the first liquid and the second liquid.

Preferably, the liquid ejecting apparatus is an ink jet recording apparatus. For the ink jet recording apparatus, in order to keep a good recording performance, the wiping operation, the sucking operation, and the capping operation are very important, and these operations are performed with high frequency. Since mixing of the first liquid and the second liquid can be prevented at this time, the performance of the recording head can be kept good.

Preferably, the first liquid is ink, and the second liquid is a fixing liquid for ink.

According to this feature, especially, in the ink jet recording apparatus, in case that the first liquid is the ink and the second liquid is the fixing liquid for ink, there is advantage that improvement of glossiness in ink jet paper and improvement of color forming ability in plain paper can be simultaneously realized by the action of the fixing liquid. However, in case that the ink and the fixing liquid mix with each other, pigment in the ink coheres, so that clogging of the nozzle opening is easy to be caused. Accordingly, it is desired that mixture of them around the recording head is avoided as much as possible. In the ink jet recording apparatus of the invention, by the constitution according to the first to third aspects, it is possible to suppress or avoid mixing of the first liquid and the second liquid during the ejection characteristic keeping operation. Therefore, while the ejection characteristic is kept and improved, clear recording that is superior in glossiness and color forming ability is realized.

In the above configurations, in the liquid ejecting apparatus including at least one main nozzle opening array for ejecting a first liquid, and at least one sub-nozzle opening array for ejecting a second liquid that is different from the first liquid in function, it is possible to prevent the first liquid and the second liquid from mixing with each other around the liquid ejecting head in the wiping operation or the sucking operation. Further, it is not necessary to individually provide the liquid ejecting heads for the first liquid and the second liquid, and individually provide the corresponding wiping members and capping members. Therefore, it is not necessary to complicate the apparatus constitution and increase the number of parts.

BRIEF DESCRIPTION OF THE DRAWING FIGURES

The above objects and advantages of the present invention will become more apparent by describing in detail preferred exemplary embodiments thereof with reference to the accompanying drawings, wherein:

FIGS. 8A and 8B are diagrams used for explanation of the cap structure, in which FIG. 8A is a plan view, and FIG. 8B is a sectional side view;

Figure 15A:
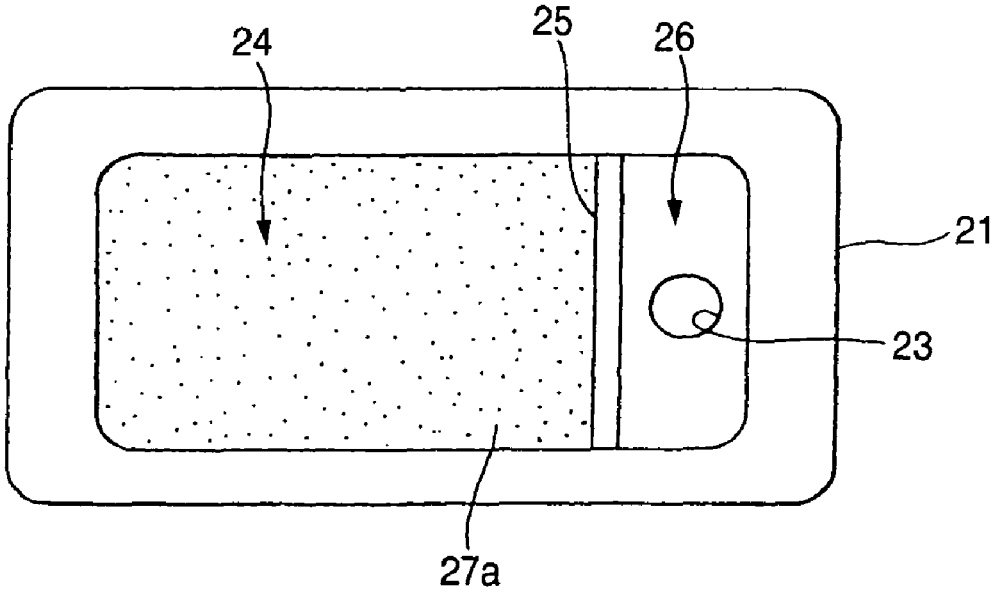
Figure 15B:
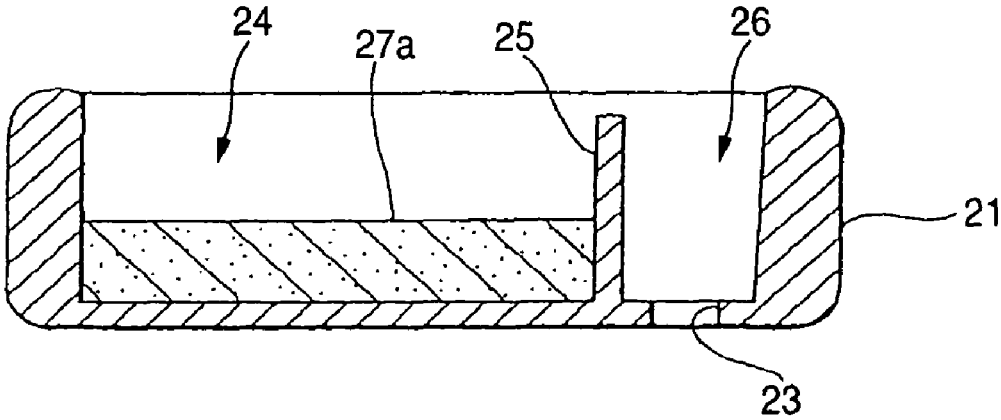
Figure 16A:
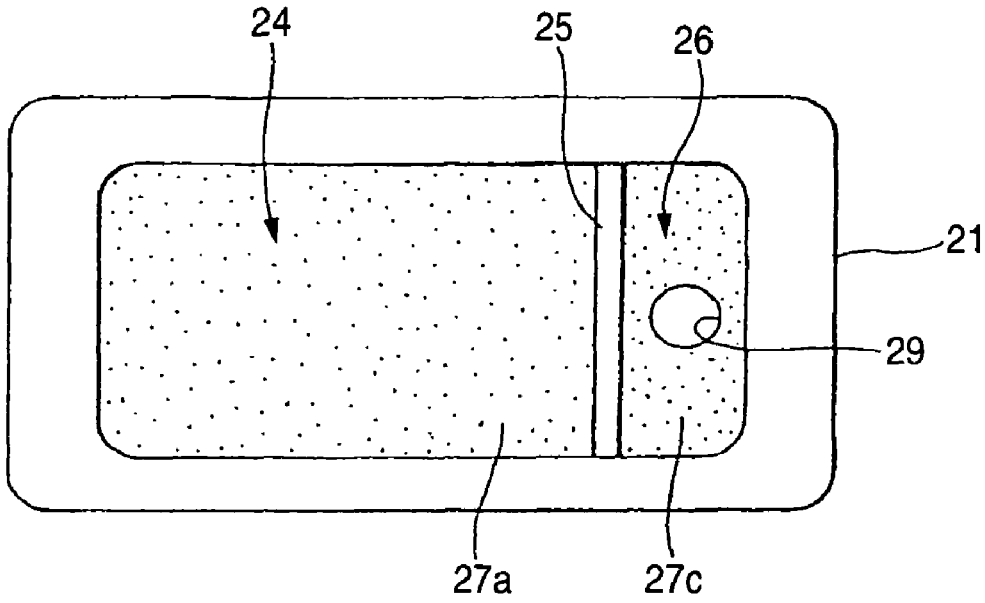
Figure 16B:
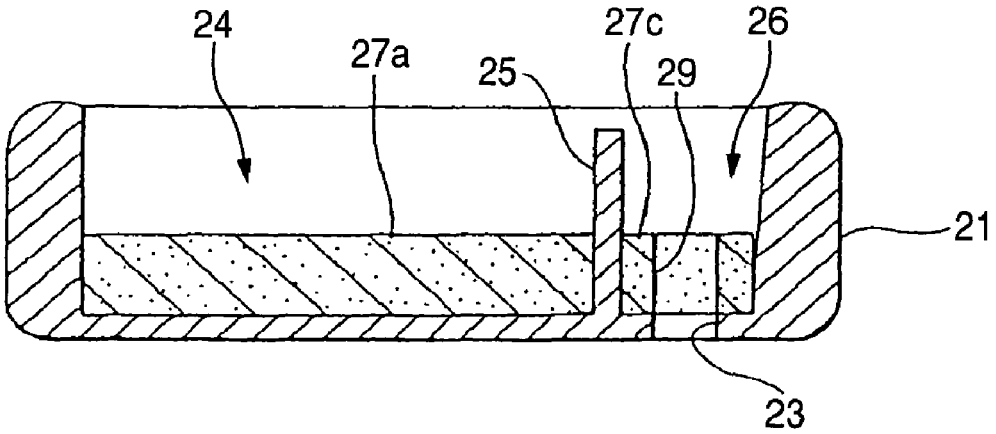
Figure 17A:
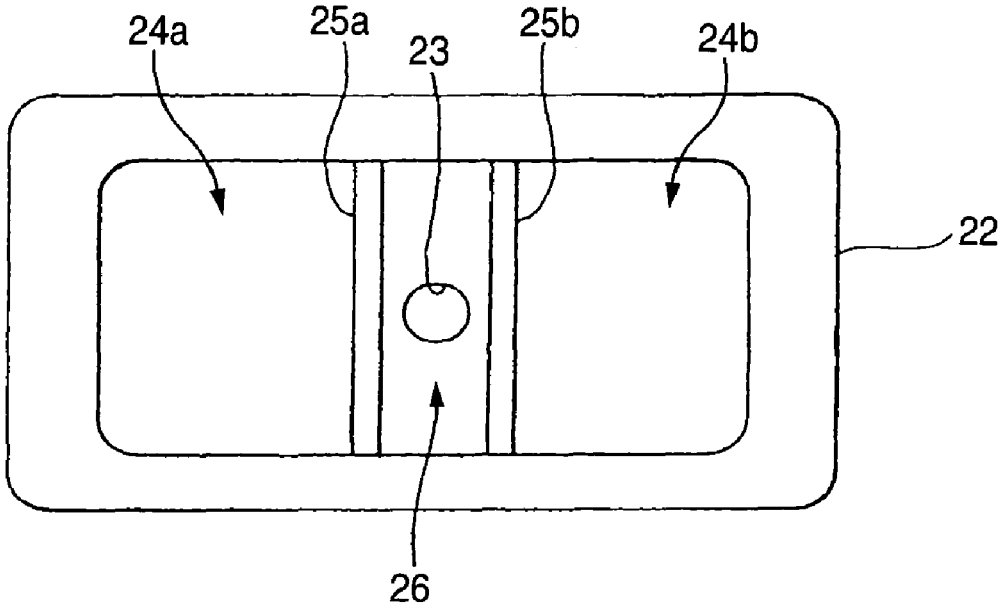
Figure 17B:
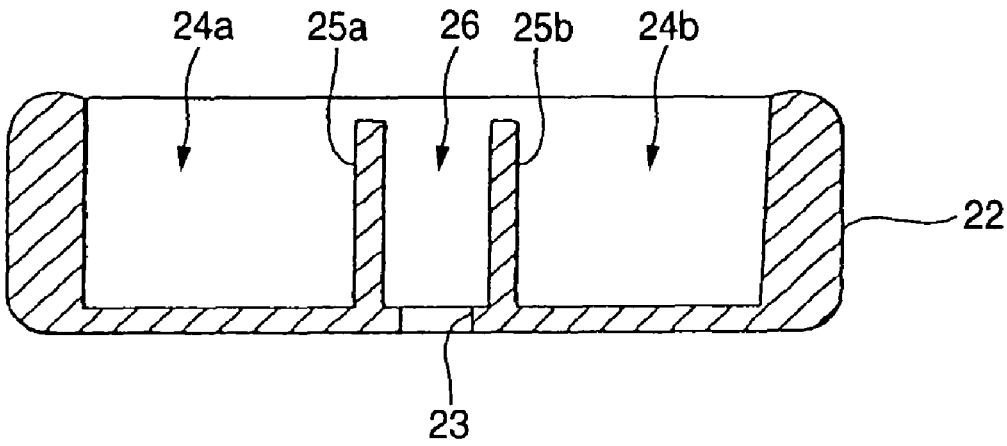
Figure 18:
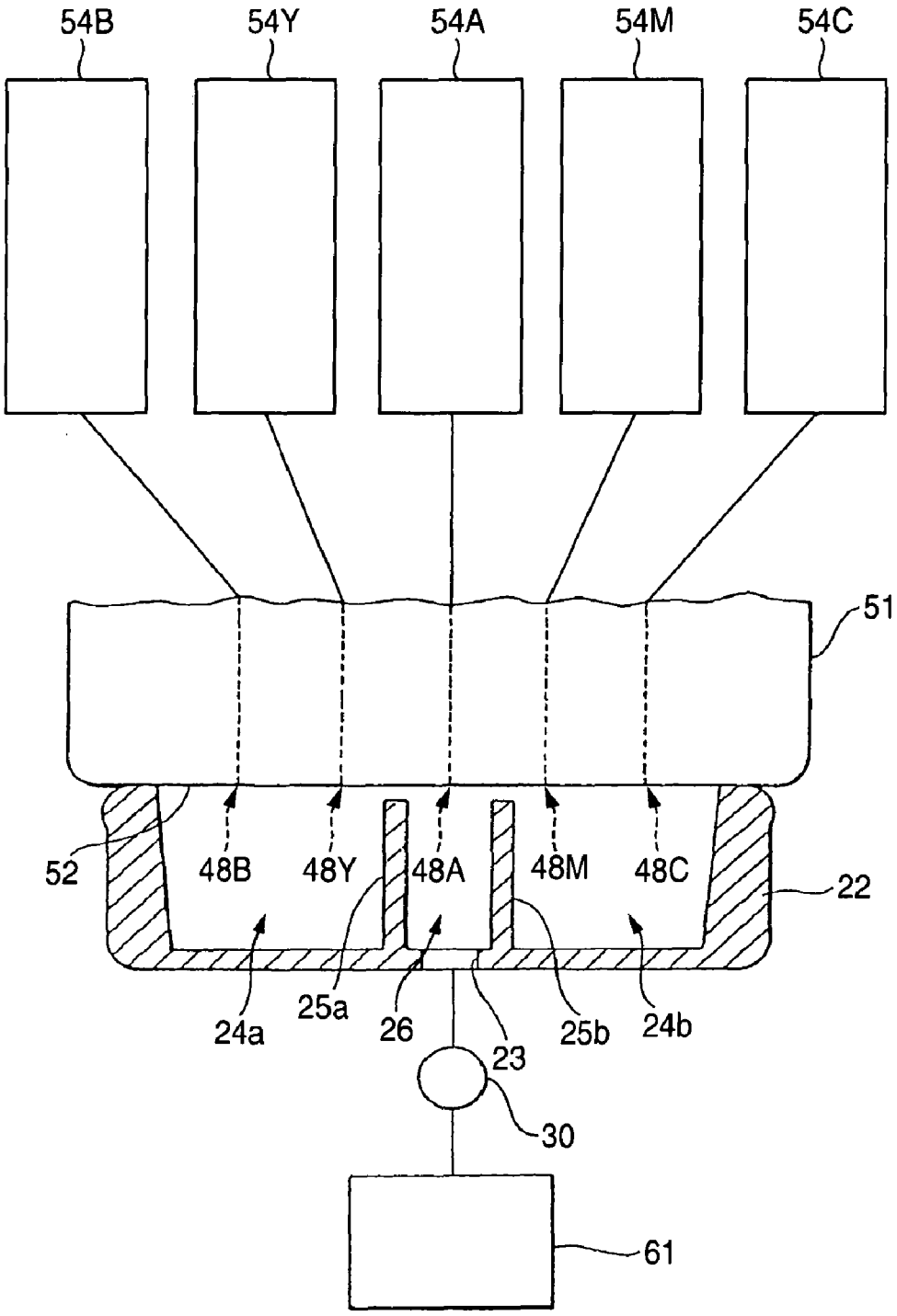
Figure 19:
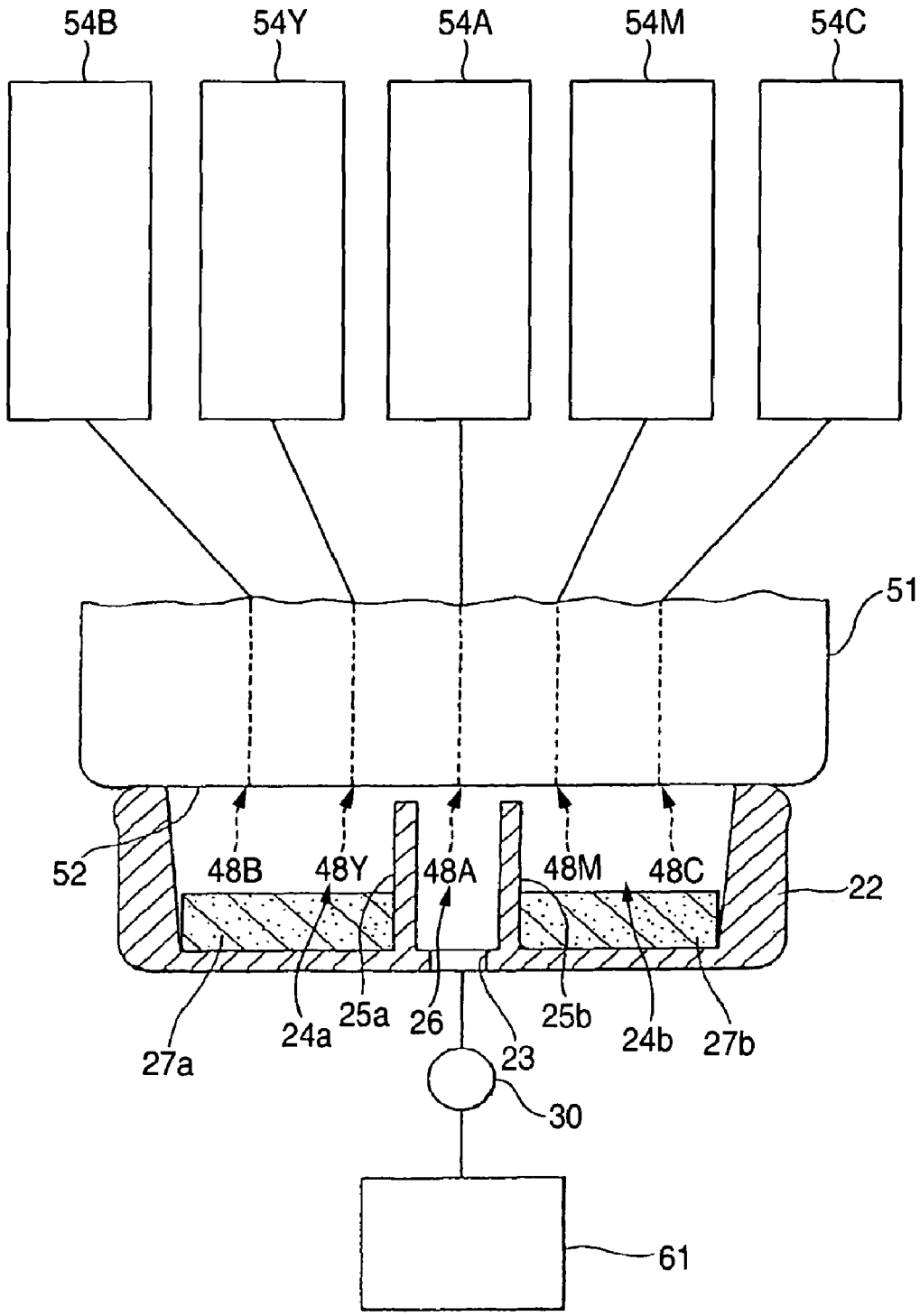

FIG. 15A is a plan view of a cap member, and FIG. 15B is a sectional side view thereof, FIG. 16A is a plan view of a cap member, and FIG. 16B is a sectional side view thereof, FIG. 17A is a plan view of a cap member, and FIG. 17B is a sectional side view thereof, FIG. 18 is a diagram showing schematically a sealing state of a nozzle forming face; and FIG. 19 is a diagram showing schematically a sealing state of a nozzle forming face.

DETAILED DESCRIPTION OF THE PREFERRED EMBODIMENTS

With an ink jet recording apparatus as a representative example of the liquid ejecting apparatus, embodiments of the invention will be described with reference to drawings.

Figure 1:
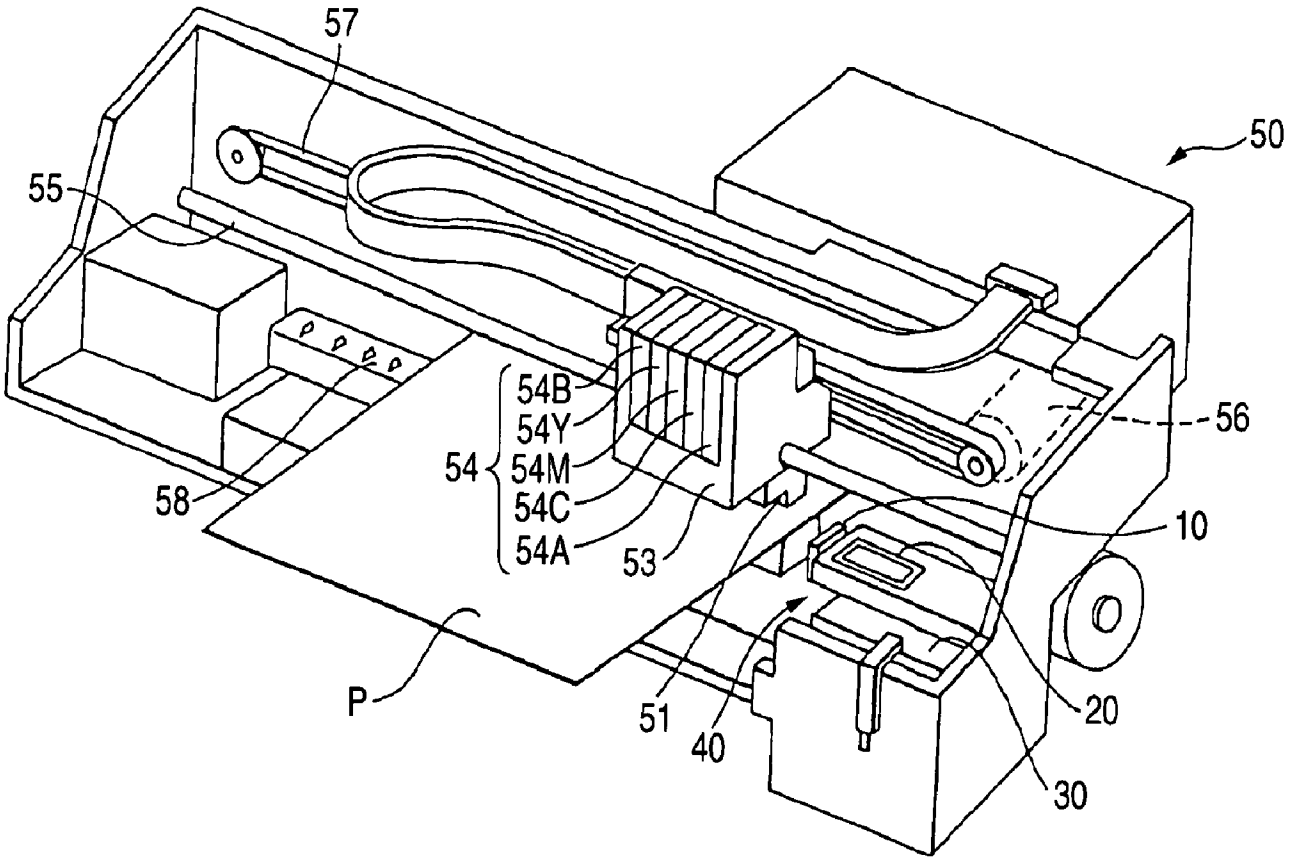
FIG. 1 is a perspective view showing an outline of an ink jet recording apparatus according a first embodiment of the invention.

FIG. 1 is a diagram showing an outline of an ink jet recording apparatus 50 according to a first embodiment of the invention. Here, in order to make the inner structure clear, the ink jet recording apparatus is shown in a state where a main body cover is detached. While a carriage 53, by a timing belt 57 connected to a drive motor 56, is reciprocating along a carriage guide shaft 55 in a main scanning direction, a recording head 51 ejects ink onto a recording medium P to perform recording. The carriage 53 is constructed so that ink cartridges 54B, 54Y, 54M and 54C for plural different colors such as black, cyan, magenta, and yellow as a first liquid can be mounted thereon, and an ink cartridge 54A for a fixing liquid as a second liquid can be also mounted thereon. As the fixing liquid held in the ink cartridge 54A, there is, for example, clear ink component which includes, as main components, water, and cationic resin such as polyethyleneimine, polyvinylamine, polyamide-polyamine, polyamidin, polydimethyl-aminoethylmethacrylate, and polydimethyl-aminoethylacrylate, and does not include colorant. This fixing liquid is attached onto the recording medium separately from the ink, whereby the color forming ability and glossiness of ink can be improved.

In a position corresponding to a home position of the carriage 53, an ejection characteristic keeping device 40 for keeping ejection characteristic of a recording head 51 is arranged. This ejection characteristic keeping device 40 comprises a wiping unit 10, a capping unit 20, and a suction unit 30. When the carriage 53 is located in its home position, this ejection characteristic keeping device 40 performs a capping operation, a sucking operation, and a wiping operation in order to keep the ejection characteristic of the recording head 51.

Figure 2:
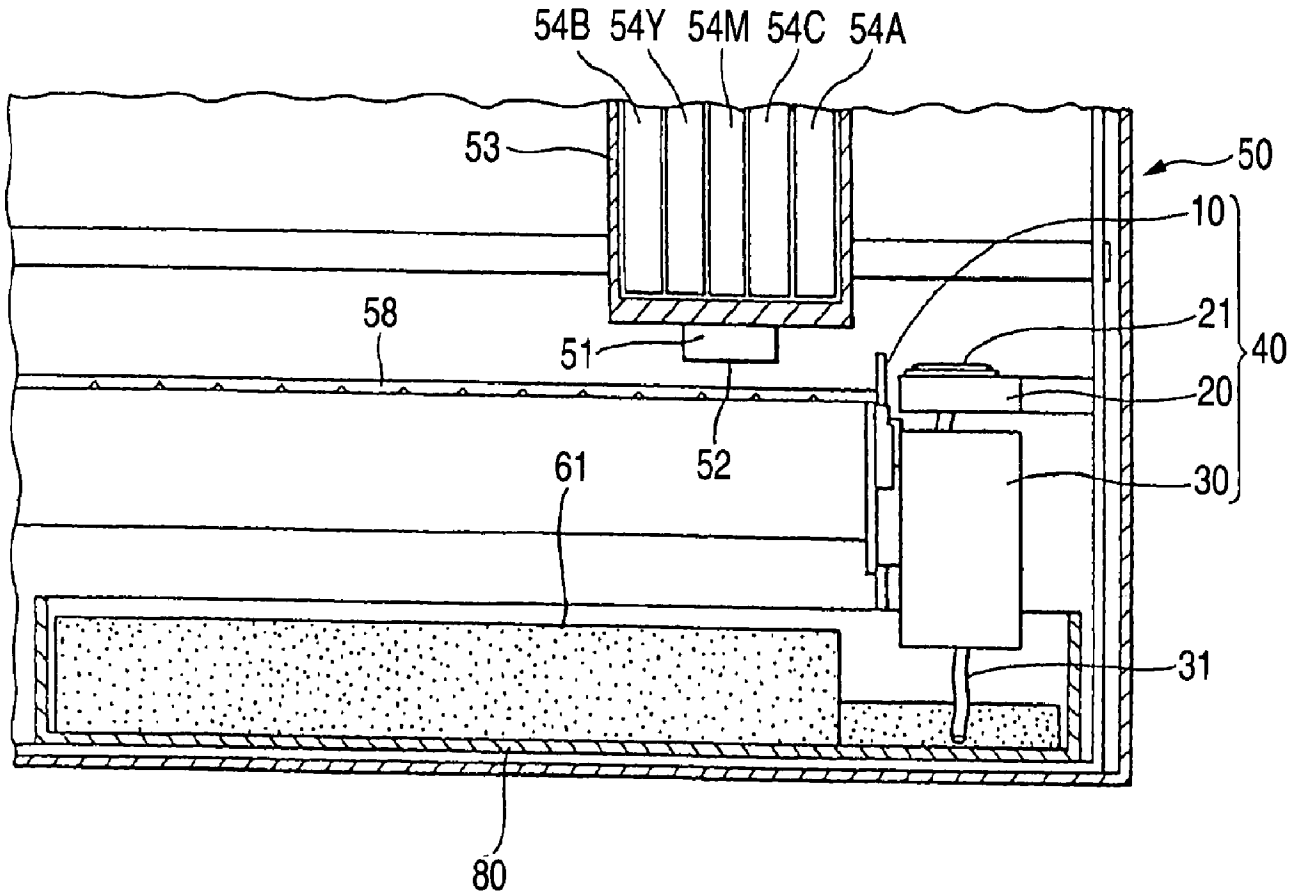
FIG. 2 is a main portion sectional view showing the inner structure of the ink jet recording apparatus.

FIG. 2 is a diagram showing a main portion of the inner structure of the ink jet recording apparatus 50 of FIG. 1.

The suction unit 30 includes a tube pump (not shown) which generates a negative pressure by pressing a flexible tube by a rotator, and is driven by power of a motor. The sucking operation by the suction unit 30 is performed in a state where the nozzle forming face 52 of the recording head 51 is sealed by a cap member 21 of the capping unit 20. The waste ink exhausted from the recording head 51 by the suction unit 30 is introduced through an exhausting tube 31 into a waste liquid tank 80, and dropped onto an ink storing portion located at one end of a waste liquid absorber 61.

Figure 3:
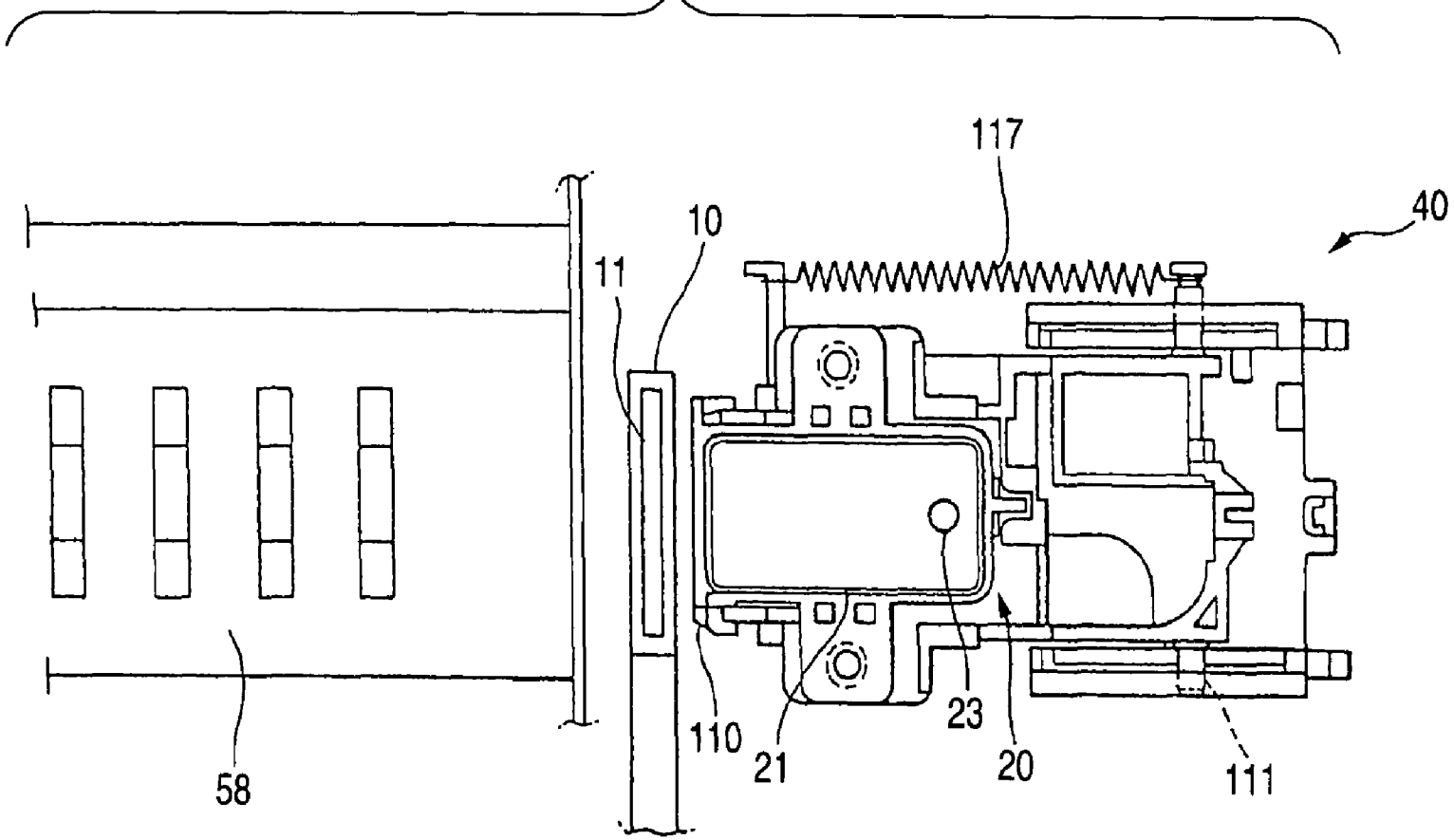
FIG. 3 is a main portion plan view of the ink jet recording apparatus.
Figure 4:
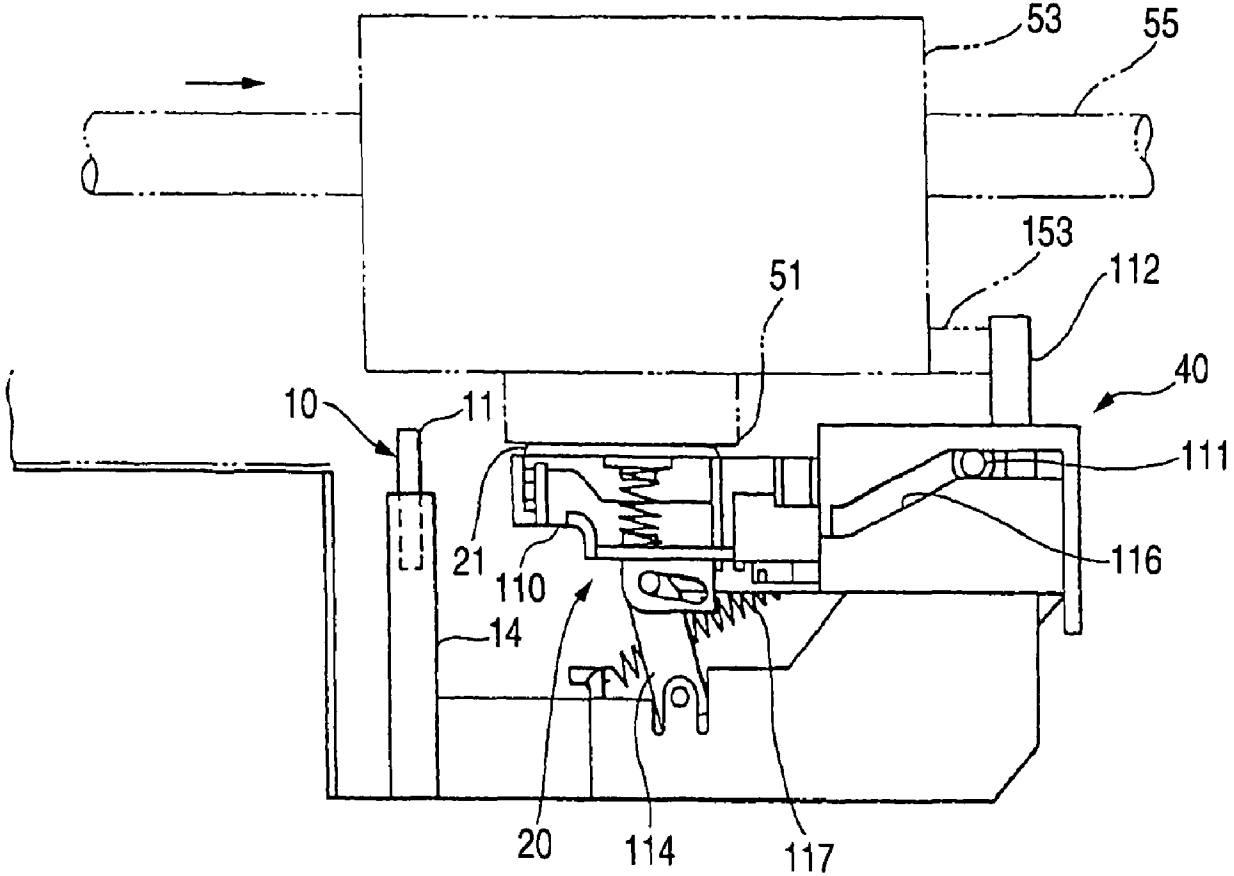
FIG. 4 is a side view of the ink jet recording apparatus.

FIG. 3 is a main portion plan view of the ink jet recording apparatus according to the embodiment, which shows an outline of the capping unit 20. Further, FIG. 4 is a main portion side view of the same. In this embodiment, the cap member 21 of the capping unit 20 includes a known displacement mechanism which can come into contact with or separate from the nozzle forming face 52 of the recording head 51.

Namely, when the drive motor 56 drives thereby to move the carriage 53 to a non-printing region on the home position side, a fitting portion 153 of the carriage 53 fits to a projection 112 of a slide member 110. With this fitting, the slide member 110 rises through an arm 114 against a tension spring 117. Then, a guide 111 of the slide member 110 moves from a low portion of a guide groove 116 through a slant portion thereof to a high portion thereof. By this operation, the cap member 21 moves to the recording head 51, and the cap member 21 comes into contact with the nozzle forming face 52 of the recording head 51. Hereby, the nozzle forming face 52 is sealed and enters in an airtight state.

On the other hand, when the carriage 53 moves to a printing region side by drive of the drive motor 56, the fitting portion 153 of the carriage 53 separates from the fitting portion of the slide member 110. Hereby, by the action of the tension spring 117, the slide member 110 descends through the arm 114. In result, the guide 111 of the slide member moves from the high portion through the slant portion to the low portion, and sealing of the recording head 51 by the cap member 21 is released.

As shown in FIG. 4, in a state where the cap member 21 seals the nozzle forming face of the recording head 51, ink is forcedly exhausted through a suction port 23 by the suction unit 30 (refer to FIG. 2), whereby the recording head 51 is cleaned.

On the printing region side adjacent to the cap member 21 of the capping unit 20, the wiping device 10 which wipes the nozzle forming face 52 of the recording head 51 with the movement of the carriage 53 is arranged.

A wiping member 11 of the wiping device 10 includes a mechanism which can move horizontally in a direction (direction perpendicular to paper surface of FIG. 4) perpendicular to a main scanning direction where the carriage 53 reciprocates, and it is constituted so that it can advance or retreat in a predetermined position in a moving passage of the recording head 51. Here, the advance or retreat operation of the wiping member 11 is performed by a known mechanism, and its power utilizes, for example, the drive power of a paper feed motor (not shown) for feeding a recording medium and the drive power of a motor of the suction pump.

Figure 5A:
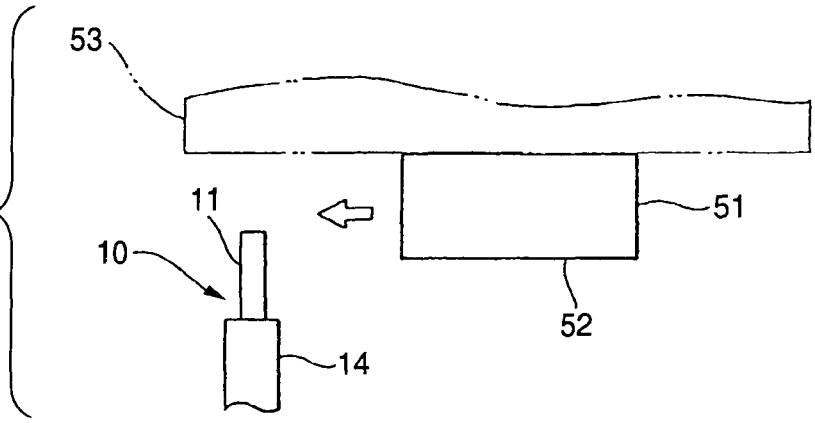
FIGS. 5A and 5B are schematic diagrams showing a wiping operation by a wiping unit.
Figure 5B:
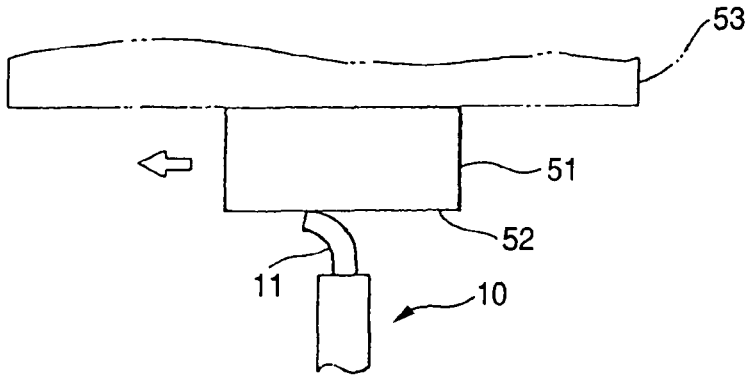

FIG. 5 is a diagram showing a wiping operation in the wiping unit 10. FIGS. 5A shows a relative position between the wiping unit and the recording head 51 before the wiping operation, and FIG. 5B shows a relative position between the wiping unit and the recording head 51 during the wiping operation. The wiping member represented by a reference numeral 11 is usually formed of a single elastic material such as elastomer, and supported by and fixed to a holder 14. As long as the wiping member 11 can move relatively on the nozzle forming face 52 of the recording head 51, it may has any constitution. Here, the wiping member 11 is constituted so that it can advance or retreat on the moving passage of the recording head 51 together with the holder 14, and it wipes the nozzle forming face 52 in the state where it advances on the passage.

More specifically, the wiping member 11 is arranged with the enough interference amounts in order to come into slide-contact with the nozzle forming face 52 of the recording head 51 (FIG. 5A). At the wiping time, for example, the wiping member 11 advances on the moving passage of the recording head 51, and the recording head 51 come to move (in a direction of an arrow in FIG. 5) in a state where the wiping member 11 stops, whereby the wiping member 11 formed of the elastic material deforms and comes into contact with the nozzle forming face 52 to wipe the nozzle forming face 52, so that the ink attached onto the nozzle forming face 52 is mechanically wiped off (FIG. 5B). By this operation, the ink attached onto the nozzle forming face 52 of the recording head 51 is removed, so that it is prevented that the ink is hardened or scatters onto the recording medium during a recording operation, and a meniscus can be stabilized.

Figure 6:
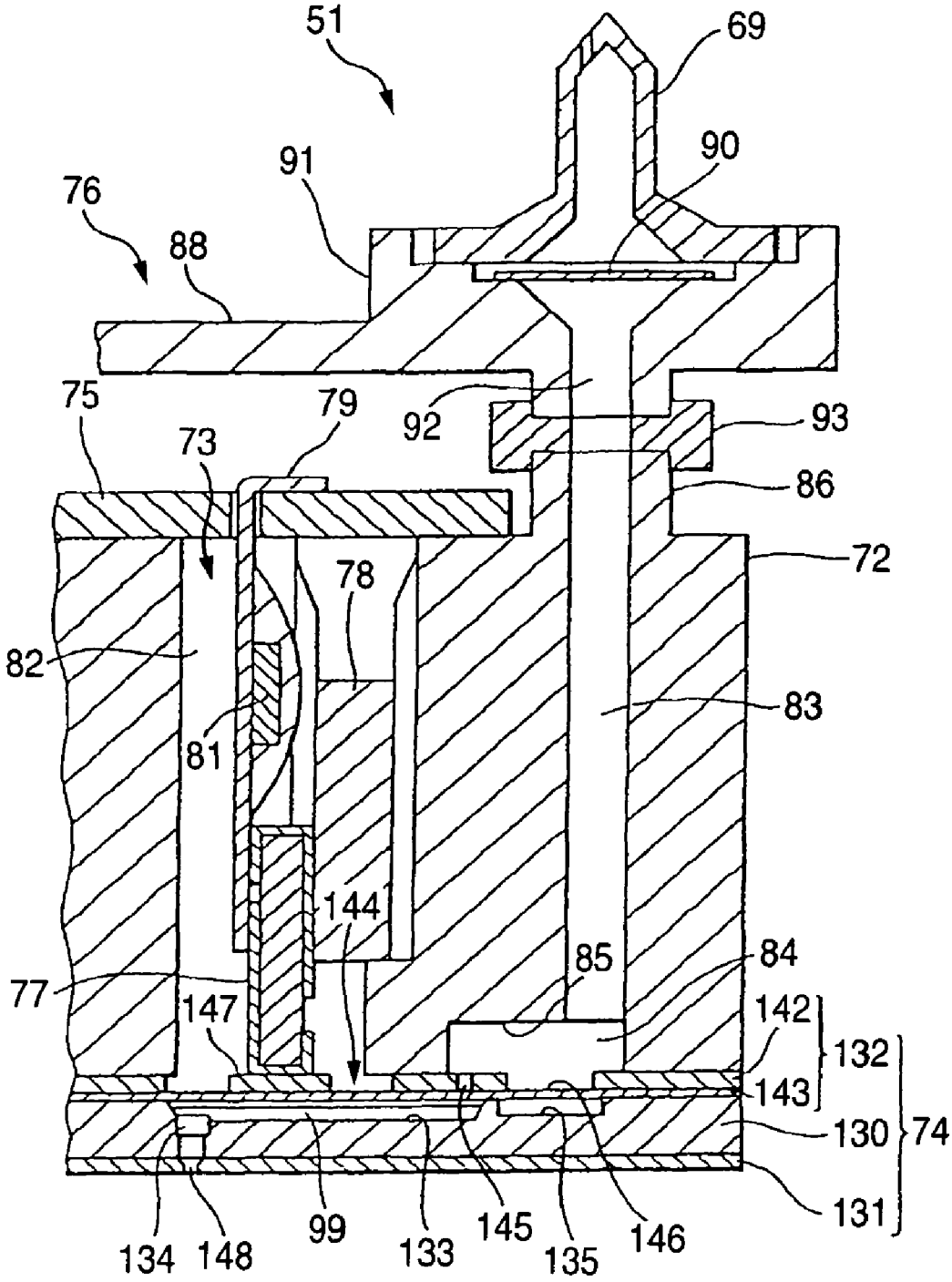
FIG. 6 is a main portion sectional view used for explanation of the inner structure of a recording head.

FIG. 6 is a diagram showing the inner structure of the recording head 51. Herein, though only the inner structure leading to a nozzle opening 148 from an ink supply needle 89 corresponding to one ink cartridge 54 is shown, the structure in which ink of each color or the fixing liquid is ejected from the nozzle opening 148 is similar to the structure shown in FIG. 6.

This recording head 51 schematically includes a case 72, a vibrator unit 73 housed in this case 72, a flowing passage unit 74 connected to one end side of the case 72, and a supply needle unit 76 arranged on the other end side of the case 72.

The supply needle unit 76 is a part to which the ink cartridge 54 is connected, and schematically includes a needle support portion 88, the ink supply needle 89, and a filter 90.

The ink supply needle 89 is a part which is inserted into the ink cartridge 54, and has a function of introducing ink stored in the ink cartridge 54. In a leading end of this ink supply needle 89, a plurality of ink induction ports communicating the inside and outside of the ink supply needle 89 are formed.

The needle-supporting portion 88 is a member for mounting the ink supply needle 89 thereon. On the face of the needle supporting portion 88, pedestals 91, having the same number as the number of ink cartridges 54, for securing the base portion of the ink supply needle 89 are formed in a lateral row. This pedestal 91 is formed in a circular shape according to the shape of a bottom face of the ink supply needle 89. Further, nearly in the center of a pedestal bottom surface, an ink outlet 92 passing through the needle-supporting portion 88 in a plate thickness direction is formed. The filter 90 is a member which prevents foreign matters in the ink such as dust and burr in molding from passing, and it is, for example, composed of a fine metal mesh net. This filter 90 is bonded to a filter holding groove formed in the pedestal 91.

This supply needle unit 76, as shown in FIG. 6, is set on an attachment surface of the case 72. In this arrangement state, the ink outlet 92 of the supply needle unit 76 and a protruding portion 86 of the case 72 communicate with each other through a seal member 93 in a liquid-tight state.

In a piezoelectric vibrator 77, its fixing end side is joined to a fixing plate 78, whereby its free end side is protruded to the outside of the leading end surface of the fixing plate 78. A free end portion of each piezoelectric vibrator 77 includes a piezoelectric element and an inner electrode which are laminated alternately. By applying potential difference between the opposed electrodes, the piezoelectric element can be expanded and contracted in the longitudinal direction.

A flexible cable 79 is connected to the piezoelectric vibrator 77 electrically. On a surface of this flexible cable 79, a control IC 81 for controlling drive of the piezoelectric vibrator 77 is arranged. Further, the fixing plate 78 supporting each piezoelectric vibrator 77 is formed of a plate-like member made of material having rigidity that can receive reaction force from the piezoelectric vibrator 77, for example, stainless.

The case 72 is a block-like member formed of thermosetting resin such as epoxy resin. Inside of the case 72, a space 82 in which the vibrator unit 73 can be housed, and a liquid supply passage 83 constituting a part of the ink flowing passage are formed. At a leading end of the case 72, a recess portion 85 that becomes a common ink chamber 84 is formed.

The space 82 has such a size that the vibrator unit 73 can be housed therein. On the leading end side of the space 82, the inner wall of the case 72 partially protrudes sideward, and the upper surface of this protruding portion functions as a fixing plate contact surface. And, the vibrator unit 73 is housed in the space 82 in a state where its leading end faces from an opening. In this housing state, the leading end surface of the fixing plate 78 is bonded in a state where it comes into contact with the fixing plate contact surface.

The recess portion 85 is formed on the right and left outside of the space 82 nearly in the shape of a trapezium, and it is formed so that the trapezoid lower bottom is located on the space 82 side.

The liquid supply passage 83 is formed so as to pass through the case 72 in a height direction, and its leading end communicates with the recess portion 85. Further, the end portion on the attachment surface side in the liquid supply passage 83 is formed in the protruding portion 86 which protrudes from the attachment surface.

A connection substrate 75 is a wiring substrate, in which electric wiring for various signals supplied to the recording head 51 is formed, and a connector that can connect a signal cable is set. This connection substrate 75 is arranged on the attachment surface of the case 72, and the flexible cable 79 is connected to the connection substrate 75.

The flowing passage unit 74 comprises a pressure generating chamber forming plate 130, a nozzle plate 131 joined to one surface of the pressure generating chamber forming plate 130, and an elastic plate 132 comprising a support plate 142 and an elastic film 143 and joined to the other surface of the pressure generating chamber forming plate 130.

The nozzle plate 131 is a plate-like member made of metal, for example, stainless, in which nozzle openings 148 are formed in array. The nozzle openings 148 are arranged at a pitch corresponding to the dot forming density. In the embodiment, the nozzle openings are formed in array thereby to constitute a nozzle array 48, and five nozzle arrays 48 are arranged in parallel.

The elastic plate 132 is joined onto one surface of the pressure generating chamber forming plate 130, that is, on a surface in which a groove-like cavity 133 is formed, whereby a diaphragm portion 144 seals an opening surface of the groove-like cavity 133 thereby to define a pressure generating chamber 99. Further, the nozzle plate 131 is joined onto the other surface of the pressure generating chamber forming plate 130, whereby the nozzle opening 148 communicates with the corresponding communication port 134. When the piezoelectric vibrator 77 joined to an island portion 147 is expanded in this state, the elastic film 143 around the island portion 147 deforms, so that the island portion 147 is pushed toward the groove-like cavity 133 or pulled in a direction where it separates from the groove-like cavity 133 side. By this deformation of the elastic film 143, the pressure generating chamber 99 expands or contracts thereby to apply the fluctuation of pressure to the ink in the pressure generating chamber 99.

Further, the elastic plate 132 (that is, flowing passage unit 74) is joined to the case 72, whereby a compliance portion 146 seals the recess portion 85. This compliance portion 146 absorbs the fluctuation of pressure of the ink stored in the common ink chamber 84. Namely, according to the pressure of the stored ink, the elastic film 143 expands or contracts to deform. A relief recess portion 135 forms space for expansion when the elastic film 143 expands.

The thus constructed recording head 51 has a common ink flowing passage from the ink supply needle 89 to the common ink chamber 84, and an individual ink flowing passage leading from the common ink chamber 84 through the pressure generating chamber 99 to each nozzle opening 148. The ink stored in the ink cartridge 54 is introduced from the ink supply needle 89, and stored through the common ink flowing passage in the common ink chamber 84. The ink stored in this common ink chamber 84 is ejected through the individual ink flowing passage from the nozzle opening 148.

For example, when the piezoelectric vibrator 77 is contracted, the diaphragm portion 144 is pulled toward the vibrator unit 73 and the pressure generating chamber 99 expands. Since the inside of the pressure generating chamber 99 becomes a negative pressure state by this expansion, the ink in the common ink chamber 84 flows through an ink supply port 145 into each pressure generating chamber 99. Next, when the piezoelectric vibrator 77 is expanded, the diaphragm portion 144 is pushed toward the pressure generating chamber forming plate 130, and the pressure generating chamber 99 contracts. By this contraction, the pressure of the ink in the pressure generating chamber 99 increases, and an ink droplet is ejected from the corresponding nozzle opening 148.

Figure 7A:
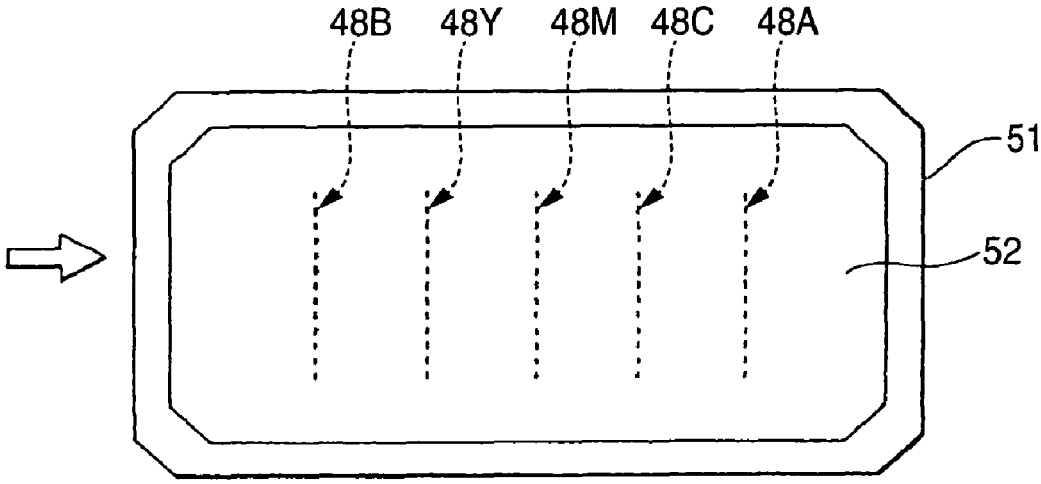
FIGS. 7A and 7B are diagrams for explaining arrangement of nozzle arrays of the recording head.
Figure 7B:
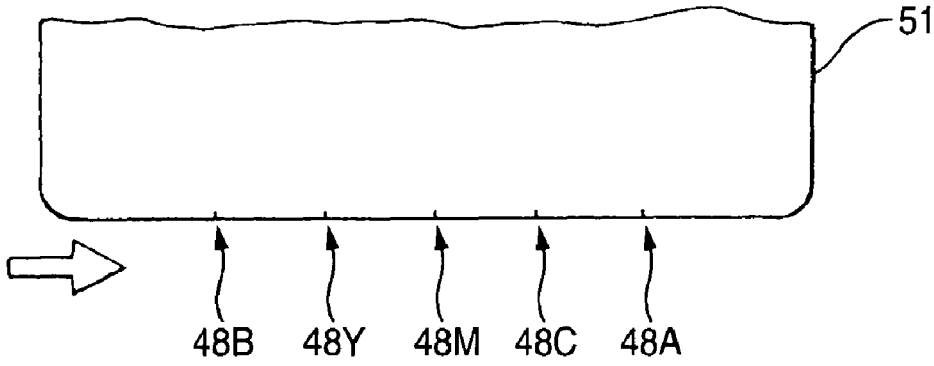

FIG. 7 is a diagram for explaining the arrangement of nozzle arrays 48 in the recording head 51 according to the embodiment, in which FIG. 7A is a plan view of the nozzle forming face 52 of the recording head 51, and FIG. 7B is a main portion side view of the recording head 51. Herein, main nozzle arrays 48B, 48Y, 48M, and 48C for respectively ejecting, as a first liquid, black ink (B), yellow ink (Y), magenta ink (M), and cyan ink (C), and a sub-nozzle array 48A for ejecting a fixing liquid (A) as a second liquid are arranged on the nozzle forming face 52 at the predetermined intervals in parallel. To each nozzle array 48, under the before-described structure (refer to FIG. 6), the ink is supplied from each ink cartridge 54.

Regarding the arrangement of the nozzle arrays 48 in this recording head 51, from the upstream to the downstream in the wiping direction (shown by an arrow in the figure) by the wiping member 11, the black ink nozzle array 48B, the yellow ink nozzle array 48Y, the magenta ink nozzle array 48M, the cyan ink nozzle array 48C, and the fixing liquid nozzle array 48A are arranged in this order. The fixing liquid nozzle array 48A is thus arranged in the most back position in the wiping direction, whereby the fixing liquid does not spread over the nozzle forming face 52 when the ink attached onto the nozzle forming face 52 is wiped by the wiping operation. Therefore, there is little fear that the fixing liquid is attached to the nozzle opening 148 of each ink thereby to cause clogging.

Figure 8A:
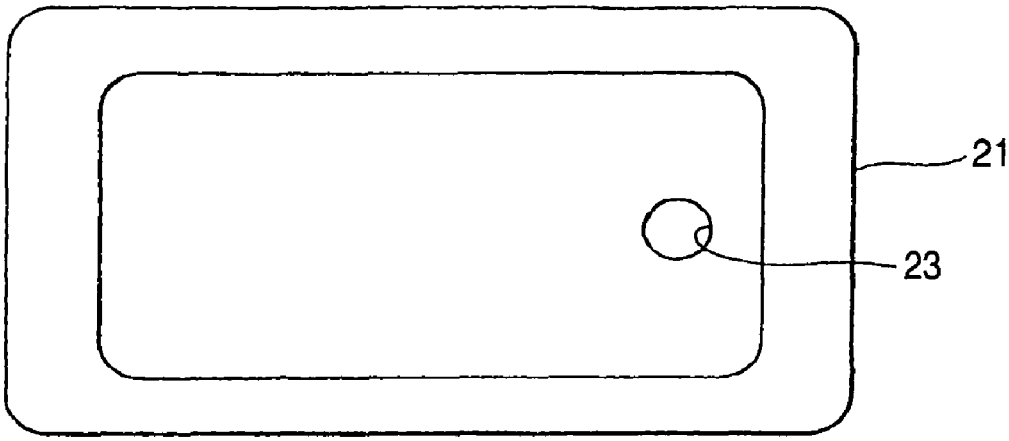
Figure 8B:
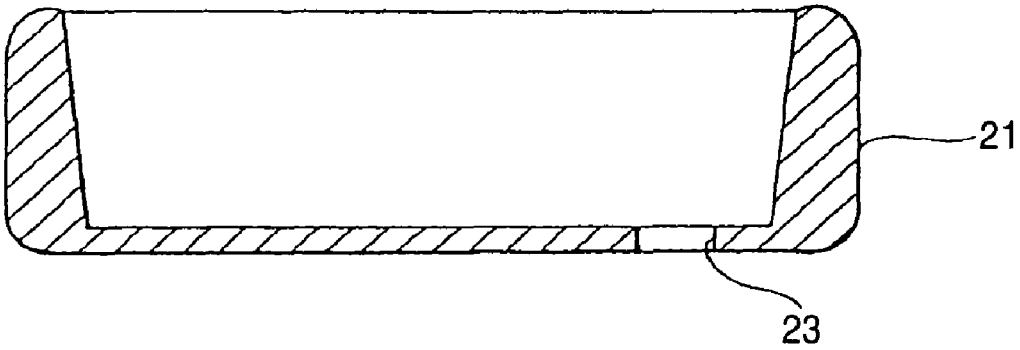

FIG. 8 is a diagram showing details of the cap member 21 according to the embodiment, in which FIG. 8A is a plan view, and FIG. 8B is a sectional side view. This cap member 21 forms a recess portion which is shallow box-shaped and opened upward. The cap member 21 body is formed of elastic material such as rubber, and its lower portion is attached into a cap case (not shown). And, the cap member 21 is constituted so that its opening edge portion can be closely attached onto the nozzle forming face 52 (nozzle plate surface) of the recording head 51 to seal the nozzle forming face 52.

At the bottom of the recess portion of the cap member 21, the suction port 23 for exhausting the waste ink in the recess portion is provided, and connected to the suction unit 30 (suction pump) as shown in FIG. 2. At the sucking operation time, the negative pressure generated by the suction unit 30 is transmitted through this suction port 23 into the recess portion of the cap member 21 which is sealing the nozzle forming face 52, and the inside of the recording head 51 becomes the negative pressure state through the nozzle opening 148. In result, the ink or a part of the fixing liquid in the recording head 51, or in the ink cartridge 54 according to circumstances is sucked and exhausted from the nozzle opening 148. The ink or the like exhausted in the recess portion of the cap member 21 is sucked from the suction port 23 to the suction unit 30.

Figure 9:
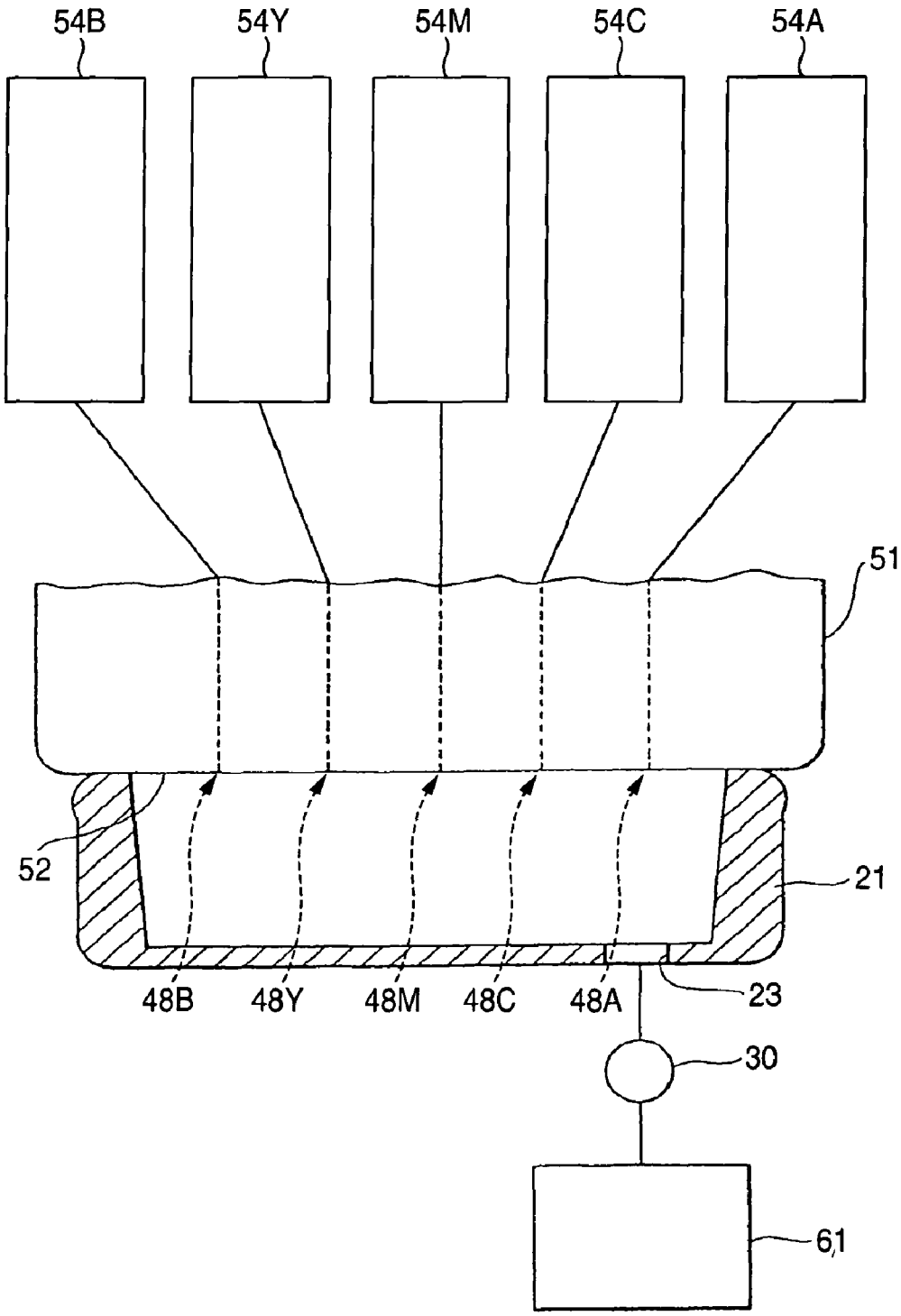
FIG. 9 is a diagram showing schematically a state where the nozzle forming face is sealed by the cap, in which the cap portion is shown in section.

In the embodiment, the suction port 23 is provided in a one-sided position on the bottom face of the cap member 21. More specifically, as shown in FIG. 9, the suction port 23 is provided in the position nearest to the fixing liquid nozzle array 48A in the state where the cap member 21 seals the nozzle forming face 52. Hereby, in case that the negative pressure is applied by the suction unit 30, the fixing liquid is preferentially sucked from the fixing liquid nozzle array 48A, and it little stays in the cap member 21. In result, even if the ink of each color is filled in the recess portion of the cap member 21, mixture of the ink with the fixing liquid is hard to be produced, so that the cohesion of pigment in the cap member 21 and the cohesion of pigment due to attachment onto the nozzle forming face 52 can be prevented. In FIG. 9, for convenience of explanation, the cap member 21 is shown in section.

As described, in the embodiment, the fixing liquid nozzle array 48A is arranged on the most downstream side in the wiping direction of the wiping member, and the suction port 23 is provided in the position nearest to the fixing liquid nozzle array 48A in the state where the cap member 21 seals the nozzle forming face 52. Therefore, at the wiping operation time or the sucking operation time, it is possible to prevent the ink and the fixing liquid from mixing with each other around the recording head 51, and it is possible to prevent cohesion matters of pigment from being produced.

For example, in FIG. 9, in order to form the suction port 23 of the cap member 21 in the position nearest to the fixing liquid nozzle array 48A, the cap member 21 is provided near the end portion of the bottom portion of the cap member 21. However, as shown in FIG. 10, in a recording head 51 in which a fixing liquid nozzle array 48A is arranged in the center of nozzle arrays, a suction port 23 can be provided near the center of a bottom portion of a cap member 21 correspondingly to the nozzle array 48A.

Figure 10:
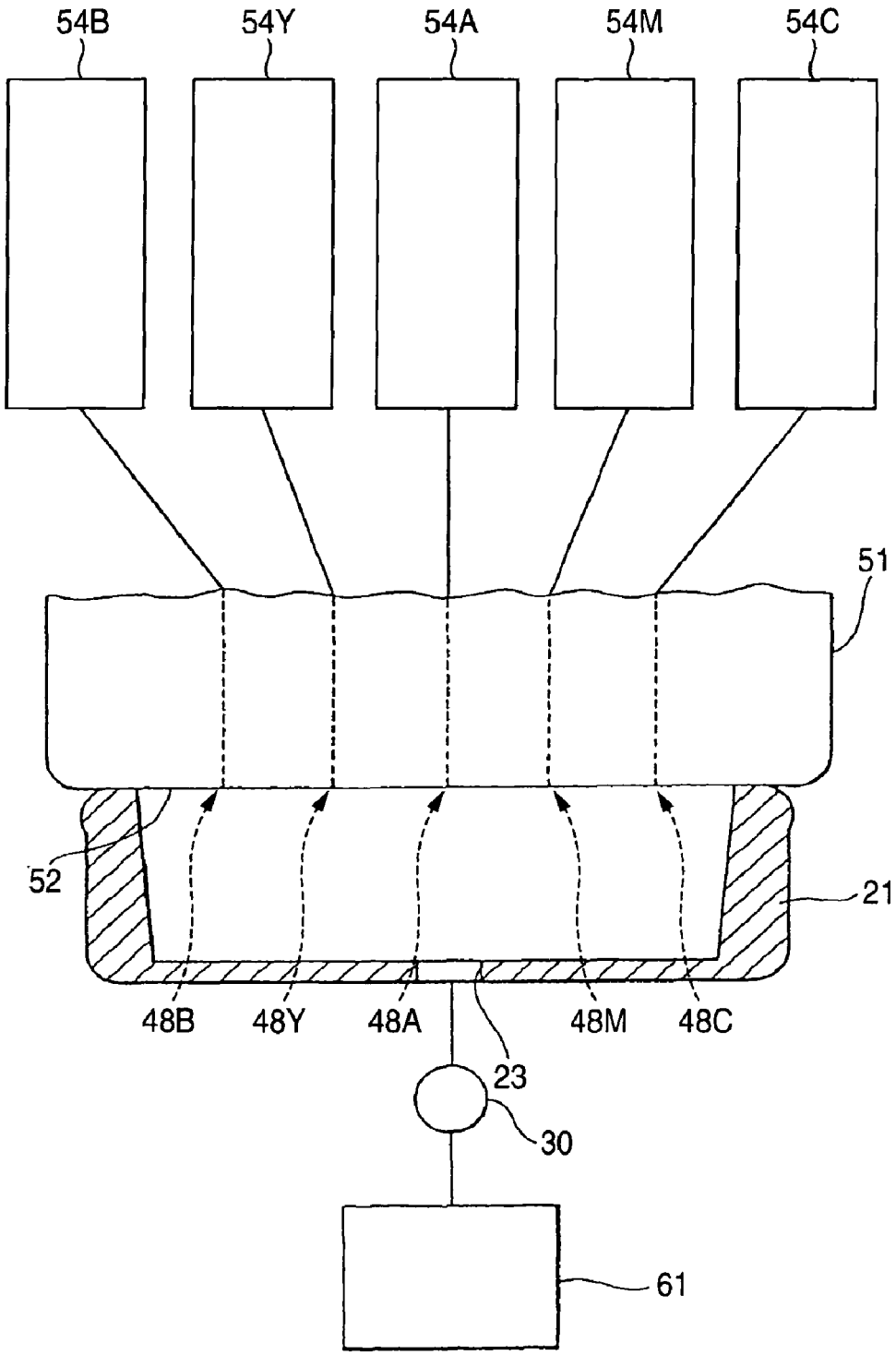
FIG. 10 is a diagram showing schematically a state where a nozzle forming face is sealed by a cap according to a second embodiment, in which the cap portion is shown in section.

Namely, in FIG. 10, the nozzle arrays are arranged in the order of a black ink nozzle array 48B, a yellow ink nozzle array 48Y, a fixing liquid nozzle array 48A, a magenta ink nozzle array 48M, and a cyan ink nozzle array 48C. And the nozzle suction port 23 is provided near the center of the bottom portion of the cap member 21 so as to be closest to the fixing liquid nozzle array 48A, so that suction of the fixing liquid is quickly performed at the sucking operation time. In this case, it is preferable that a wiping operation by a wiping unit 10, in order to prevent mixing of the ink and the fixing liquid, is performed by relatively moving a wiping member 11 in the same direction as the direction of extending of each nozzle array 48 (that is, direction perpendicular to paper face of FIG. 10).

Figure 11A:
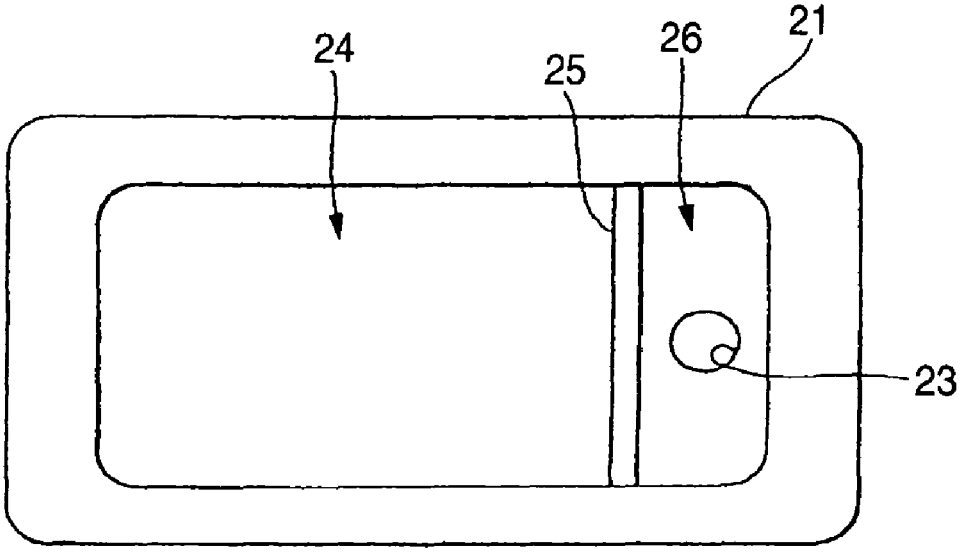
FIG. 11A is a plan view of a cap member.
Figure 11B:
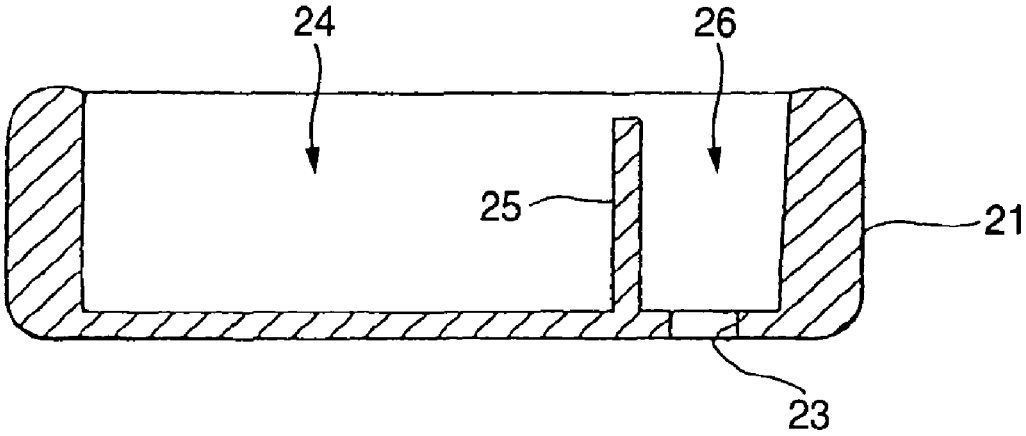
FIG. 11B is a sectional side view thereof.
Figure 12:
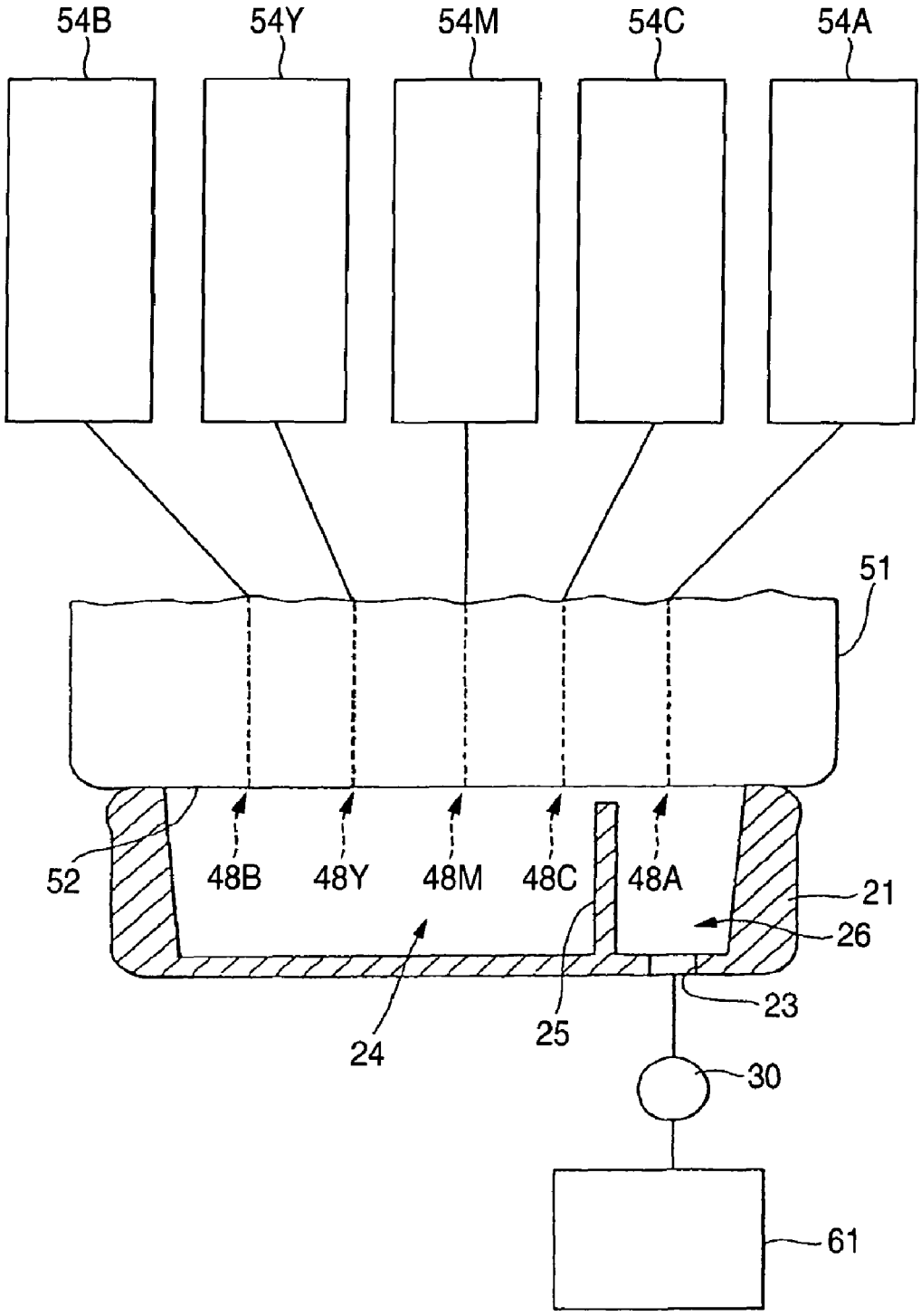
FIG. 12 is a diagram showing schematically a sealing state of a nozzle forming face.

Further, in the cap member 21 as shown in FIG. 11 and 12, a wall body 25 stands from its bottom portion toward its opening portion. By this wall body 25, the inside of the recess portion of the cap 21 is divided into an ink chamber 24 as a first liquid receiving portion and a fixing liquid chamber 26 as a second liquid receiving portion. Namely, the wall body 25 functions as a defining member which defines the ink chamber 24 and the fixing liquid chamber 26.

The wall body 25 is formed so that its top does not come into contact with the nozzle forming face 52 in the state where the cap member 21 comes into contact with the nozzle forming face 52. In other words, in the sealing state of the nozzle forming face 52 by the cap member 21, the predetermined distance is provided between the wall body 25 and the nozzle forming face 52. By forming such the distance, in the state where the ink chamber 24 and the fixing liquid chamber 26 are divided by the wall body 25, the both chambers can communicate with each other partially Further, in case that the negative pressure is applied into the recess portion of the cap member 21 by the sucking unit 30 in the state where the nozzle forming face 52 is sealed by the cap member 21, the ink in the recording head 51 is sucked in the ink chamber 24, and the fixing liquid is sucked in the fixing liquid chamber 26. In this step, the waste ink and the waste fixing liquid are partitioned by the wall body 25. Therefore, they do not mix with each other in the recess portion of the cap member 21.

Sequentially, the sucking operation is performed to set the inside of the cap member 21 in the pressure reduced state, whereby the waste fixing liquid of the fixing liquid chamber 26 is succeedingly exhausted from the suction port 23, but the waste ink sucked in the ink chamber 24 stays in the ink chamber 24 till the pressure reduced state in the cap member 21 is sufficiently heightened. Also after the waste fixing liquid in the fixing liquid chamber 26 has been exhausted, the sucking operation is performed continuously, whereby the ink in the ink chamber 24 lastly gets over the wall body 25 to moves to the fixing liquid chamber 26, and is exhausted from the suction port 23. These operations are performed continuously and momentarily. As described above, the suction port 23 is provided for only the fixing liquid chamber 26, and the distance is provided between he top of the wall portion 25 and the nozzle forming face 52 to communicate the ink chamber 24 and the fixing liquid chamber 26 with each other, whereby the waste fixing liquid and the waste ink are exhausted with difference of time from the space in the cap member 21. Accordingly, at the cap member 21, and particularly at a portion of the suction port 23 where it is feared that clogging is produced, mixing of the both liquids can be avoided, so that clogging can be prevented. Further, in order to accelerate the exhaust of the waste ink from the ink chamber 24, an air open valve (not shown) can be provided on the ink chamber 24 side.

Further, in the cap 21 according to the embodiment, not only in the sucking operation but also in the flashing operation, mixing of the waste ink and the waste fixing liquid can be prevented similarly to the foregoing. Flashing is an operation of moving the recording head 51 to the capping position at the timing after the printing operation was continued for a constant time or after the sucking operation was performed, and of extra shooting the predetermined number of ink droplets to the cap 21 in order to prevent or remove clogging of the nozzle 148. Also, in this flashing operation, the waste ink and the waste fixing liquid are partitioned by the wall body 25, so that they do not mix with each other in the recess portion of the cap member 21.

Figure 13A:
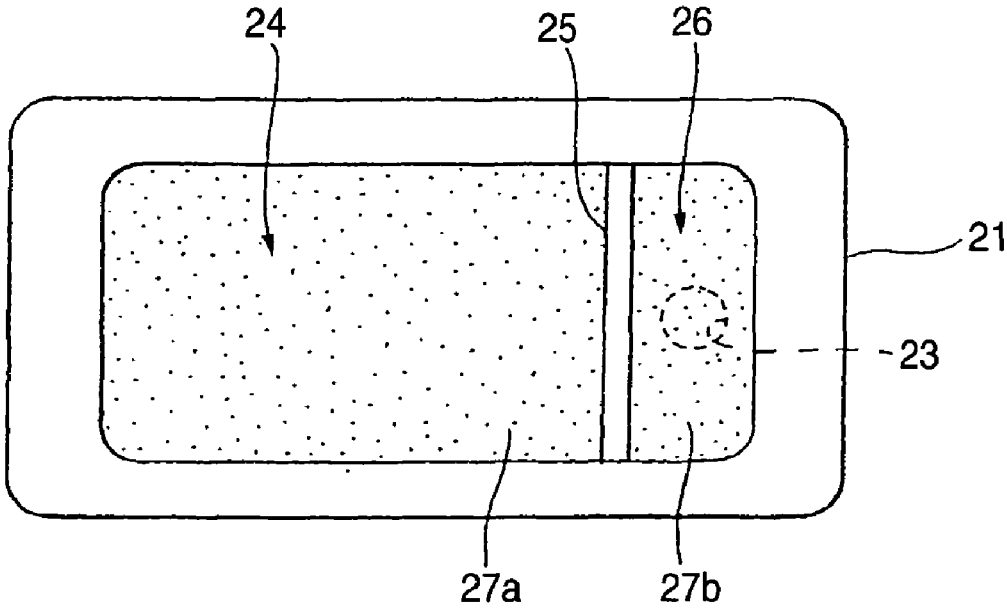
FIG. 13A is a plan view of a cap member.
Figure 13B:
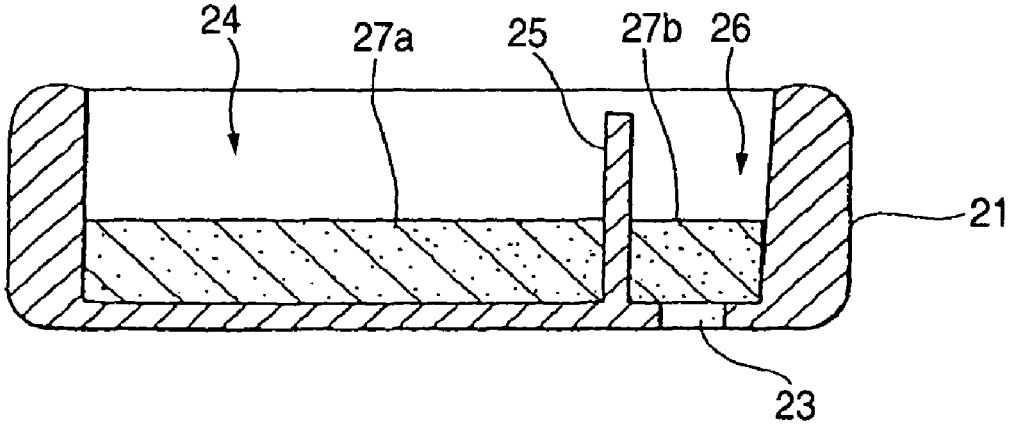
FIG. 13B is a sectional side view thereof.

FIGS. 13 and 16 shows states where a moisture keeping sheet 27 as a dry preventing member is provided for the cap member 21. FIGS. 13A, 15A, and 16A are plan views of the cap member 21, and FIGS. 13B, 15B, and 16B are sectional side views. The moisture keeping sheets 27*a*, 27*b*, and 27*c* are made of porous material such as foaming urethane, can include moisture component according to necessity, and can use laminated porous materials that are different in mesh diameter. By the moisture keeping sheets 27*a*, 27*b*, and 27*c* provided for the cap member 21, the space sealed by the cap member 21 is kept at the constant humidity by vapor generated from the waste ink and waste fixing liquid absorbed in the moisture keeping sheets 27*a*, 27*b*, and 27*c* in the state where the nozzle forming face 52 is sealed at the non-recording time, so that dry of the nozzle can be prevented.

Figure 14:
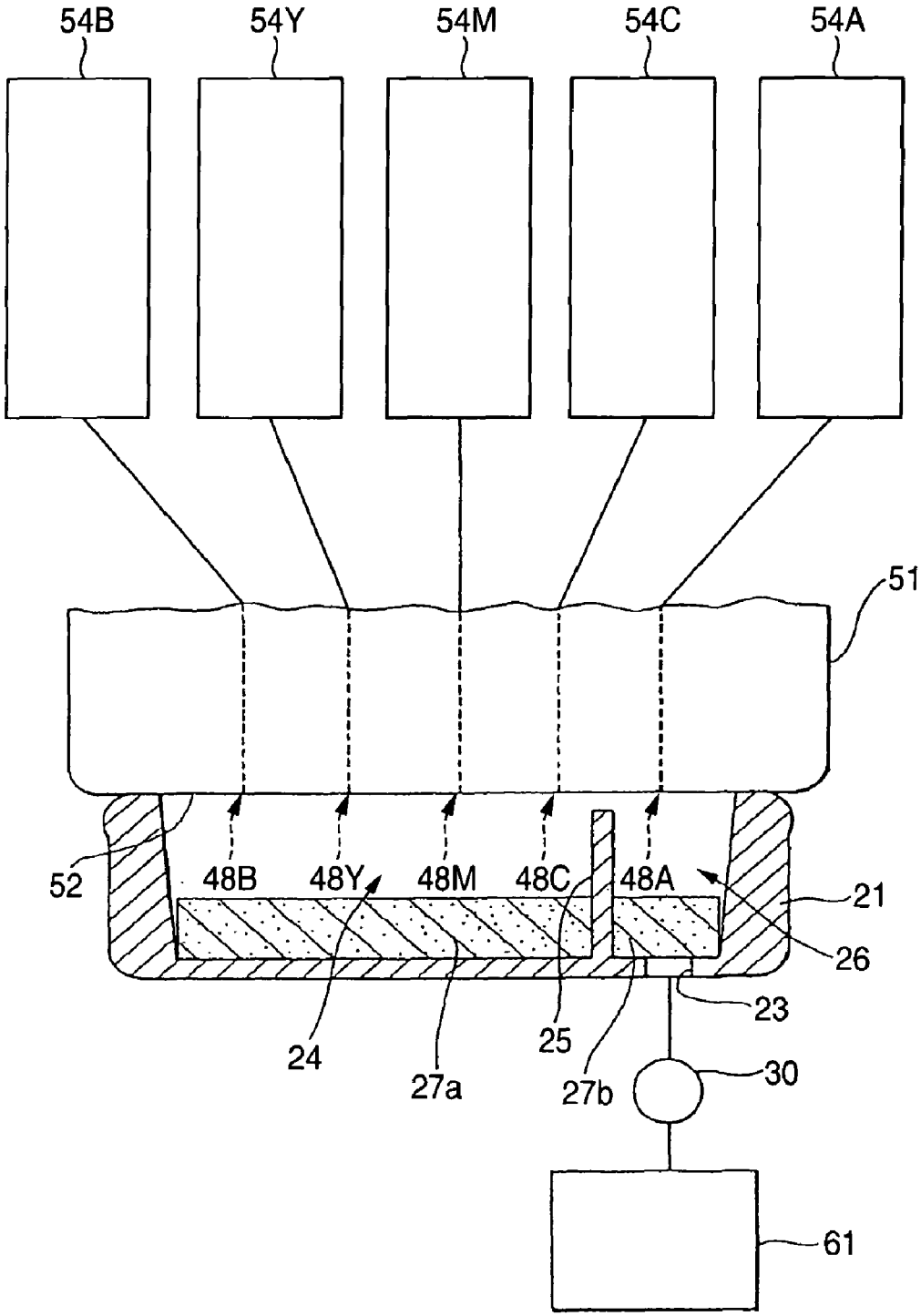
FIG. 14 is a diagram showing schematically a sealing state of a nozzle forming face.

FIGS. 13 and 14 show the moisture keeping sheets 27*a* and 27*b* arranged at the lower portions of the ink chamber 24 and the fixing liquid chamber 26 of the cap member 21. In the sucking operation, regarding the ink and fixing liquid ejected in the cap member 21, firstly, the fixing liquid in the fixing liquid chamber is exhausted through the suction port 23 as described above, and thereafter the ink in the ink chamber 24 flows into the fixing liquid chamber so as to go around the wall body 25 and is exhausted. Since the waste fixing liquid and the waste ink thus pass through the suction port 23 with different of time, occurrence of clogging of the porous material-made moisture keeping sheet 27 located on the fixing liquid chamber 26 side can be reduced.

FIG. 15 shows the moisture keeping sheet 27*a* arranged at the lower portion of only the ink chamber 24 of the cap member 21. In case that the moisture keeping sheet 27*a* is arranged on only the ink chamber 24 side and the moisture keeping sheet is not provided for the fixing chamber 26, a possibility that clogging is produced in the moisture keeping sheet 27*a* by reaction between the ink flowing from the ink chamber 24 at the sucking operation time and the fixing liquid can be completely avoided. Further, moisture keeping in the sealing time that is a natural action of the moisture keeping sheet 27*a* is achieved sufficiently by the moisture keeping sheet 27*a* on the ink chamber 24 side.

Namely, since the wall body 25 defining the ink chamber 24 and the fixing liquid chamber 26 is formed with the predetermined distance from the nozzle forming face 52 of the recording head 51 in the capping state (nozzle forming face sealing state), the both chambers communicate with each other also in the capping state. In result, the moisture volatilizing from the ink chamber 24 side is filled also in the fixing liquid chamber 26, and the both chambers are kept in the uniform state.

FIG. 16 shows a modified example of FIG. 13, in which the moisture keeping sheets 27*a* and 27*c* are provided for the both of the ink chamber 24 and the fixing liquid chamber 26, and a through-hole 29 is formed in the moisture keeping sheet 27*c* on the fixing liquid chamber 26 side so as to correspond to the suction port 23. By this through-hole 29, the fixing liquid and the ink are readily exhausted at the sucking time. Further, since the suction port 23 is not covered with moisture keeping sheet 27*c*, occurrence of clogging can be reduced.

Further, in the caps 21 in the modes shown in FIGS. 13 to 16, mixing of the waste ink and the waste fixing liquid can be prevented not only at the sucking operation time but also at the flashing operation time similarly to the foregoing.

Namely, also in the flashing operation, the waste ink and the waste fixing liquid are partitioned by the wall body 25, whereby they do not mix with each other in the recess portion of the cap member 21. In the construction as shown in FIGS. 13 and 16, the ink and the fixing liquid are extra shot to the moisture keeping sheets 27*a*, 27*b* or the moisture keeping sheets 27*a*, 27*c* by the flashing operation. In the construction as shown in FIG. 15, the ink and the fixing liquid are extra shot to the moisture keeping sheet 27*a* and the fixing liquid chamber 26. However, since the waste ink and the waste fixing liquid are partitioned by the wall body 25, they do not come into contact with each other in the cap 21.

FIG. 17 shows a cap member 22 according to a second embodiment of the invention, in which FIG. 17A is a plan view, and FIG. 17B is a sectional side view. Further, FIG. 18 is a schematic diagram for explaining a state where a nozzle forming face of an ink jet recording apparatus 51 is sealed by the cap member 22, in which the cap member 22 is shown in sectional structure for convenience of explanation. In the cap member 22 according to this embodiment, a space defined by a pair of wall bodies 25*a* and 25*b* is used as a fixing liquid chamber 26, and ink chambers 24*a* and 24*b* are arranged between both sides of the fixing liquid chamber 26. Such the constitution of the cap member 22 is set according to arrangement of nozzle arrays in the recording head 51.

Namely, in the recording head 51 shown in FIG. 18, the nozzle arrays are arranged in the order of a black ink nozzle array 48B, a yellow ink nozzle array 48Y, a fixing liquid nozzle array 48A, a magenta ink nozzle array 48M, and a cyan ink nozzle array 48C. And a nozzle suction port 23 is provided near the center of the bottom portion of the cap member 21 so as to be closest to the fixing liquid nozzle array 48A, so that suction of the fixing liquid is quickly performed at the sucking operation time. A pair of wall bodies 25*a* and 25*b* stand so as to put the suction port 23 between them, and define the ink chamber 24*a* functioning mainly as a receiving portion for black ink and yellow ink, the fixing liquid chamber 26, and the ink chamber 24*b* functioning mainly as a receiving portion for magenta ink and cyan ink. In this case, it is preferably that a wiping operation by a wiping unit 10 is executed by relatively moving a wiping member 11 in the same direction of the direction of extending of each nozzle array 48 (direction perpendicular to the paper surface of FIG. 18) in order to avoid mixing of the ink and the fixing liquid.

Also in this embodiment, the motion of the ink and fixing liquid in the cap member 22 at the sucking operation time is similar to that in the first embodiment. Firstly, the waste fixing liquid ejected in the fixing liquid chamber 26 is preferentially exhausted from the suction port 23, and next the waste ink in the ink chambers 24*a* and 24*b* diffract the top of the wall body 25*a* or 25*b* and flow in the fixing liquid chamber 26 thereby to be exhausted from the suction port 23. In order to accelerate the exhaust of the waste ink, air open valves (not shown) can be provided for the ink chambers 24*a* and 24*b* according to necessity.

FIG. 19 is a schematic diagram showing moisture keeping sheets 27*a* and 27*b* arranged at the lower portions of the ink chambers 24*a* and 24*b* in the cap member 22 in FIGS. 17 and 18. Here, the moisture keeping sheet is not provided for the fixing liquid chamber 26. The moisture keeping sheets 27*a* and 27*b* are thus arranged on only the sides of the ink chambers 24*a* and 24*b*, and the moisture keeping sheet is not provided for the fixing liquid chamber 26, whereby clogging is never produced in the moisture keeping sheet by reaction between the ink flowing from the ink chamber 24 at the sucking operation time and the fixing liquid. Further, moisture keeping in the sealing time is achieved sufficiently by the moisture keeping sheets 27*a* and 27*b* on the sides of the ink chambers 24*a* and 24*b*, and by the communication due to the upper spaces of the wall bodies 25*a* and 25*b*.

Though the invention has been described above in term of the various embodiments, it is not limited to the above embodiments but can be applied also to another embodiment within the scope of the invention described in the scope of patent claims.

For example, as a representative example of the liquid ejecting apparatus, the ink jet recording apparatus has been described in the above embodiments. However, the invention is not limited to this. The technical idea of the invention can be similarly applied to a liquid ejecting apparatus such as a color material ejecting apparatus having a color material ejecting head used in manufacture of a color filter of a liquid crystal display, an electrode material ejecting apparatus having an electrode material (electric conducting paste) ejecting head used in formation of electrodes of an organic EL display and FED (face light emitting display), a bioorganic matter ejecting apparatus having a bioorganic matter ejecting head used in manufacture of biochip, or a sample ejecting apparatus having a sample ejecting head used as a precise pipette.

What is claimed is:

1. A liquid ejecting apparatus, comprising:

a liquid ejecting head, including:

a nozzle forming face having a plurality of nozzle opening arrays which are arranged in parallel to each other;

wherein each of the nozzle opening arrays has plural nozzle openings; and wherein the nozzle opening arrays includes at least one main nozzle opening array for ejecting a first liquid and at least one sub-nozzle opening array for ejecting a second liquid which is different from the first liquid in function;

a plurality of pressure generating chambers, communicating with the nozzle openings respectively; and a plurality of pressure generating members, applying pressure to liquid in the pressure generating chambers respectively so as to eject the liquid from the nozzle openings; and a wiping member, wiping the nozzle forming face, wherein an extending direction of each of the nozzle opening arrays is perpendicular to a wiping direction in which the wiping member wipes; and wherein the sub-nozzle opening array is arranged on the more downstream side in the wiping direction than the main nozzle opening array.

2. The liquid ejecting apparatus as set forth in claim 1, wherein the liquid ejecting apparatus is an ink jet recording apparatus.

3. The liquid ejecting apparatus as set forth in claim 1, wherein the first liquid is ink, and the second liquid is a fixing liquid for ink.

4. The liquid ejecting apparatus of claim 1 wherein the wiping direction is a direction that the wiping member wipes when the liquid ejecting head moves from a non-printing region to a printing region.

5. The liquid ejection apparatus as set forth in claim 1, wherein the first liquid is ink, and the second liquid is a liquid reacting with the first liquid.

* * * * *